US010642187B2

(12) United States Patent
Chikugo

(10) Patent No.: US 10,642,187 B2
(45) Date of Patent: May 5, 2020

(54) IMAGE FORMING APPARATUS

(71) Applicant: CANON KABUSHIKI KAISHA, Tokyo (JP)

(72) Inventor: Youichi Chikugo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 196 days.

(21) Appl. No.: 15/974,859

(22) Filed: May 9, 2018

(65) Prior Publication Data

US 2018/0335718 A1 Nov. 22, 2018

(30) Foreign Application Priority Data

May 22, 2017 (JP) ..... 2017-100637
Apr. 13, 2018 (JP) ..... 2018-077409

(51) Int. Cl.

| | |
|---|---|
| ***G03G 15/20*** | (2006.01) |
| ***G03G 15/08*** | (2006.01) |
| ***G03G 15/00*** | (2006.01) |
| ***B41J 11/00*** | (2006.01) |
| ***B41J 13/03*** | (2006.01) |

(52) U.S. Cl.

CPC ..... *G03G 15/087* (2013.01); *B41J 11/006* (2013.01); *B41J 13/03* (2013.01); *G03G 15/2028* (2013.01); *G03G 15/607* (2013.01); *G03G 15/70* (2013.01); *G03G 2215/00734* (2013.01); *G03G 2215/2045* (2013.01)

(58) Field of Classification Search

CPC ..... G03G 15/2028
USPC ..... 101/232
See application file for complete search history.

(56) References Cited

U.S. PATENT DOCUMENTS

| | | | | |
|---|---|---|---|---|
| 4,937,622 | A * | 6/1990 | Makiura | G03G 15/70 271/259 |
| 5,365,322 | A | 11/1994 | Hamada et al. | |
| 5,713,059 | A * | 1/1998 | Ishikawa | B41J 29/393 226/100 |
| 6,909,857 | B2 * | 6/2005 | Tanaka | G03G 15/16 271/270 |
| 7,549,629 | B2 | 6/2009 | Tateishi et al. | |
| 7,597,311 | B2 | 10/2009 | Kawata et al. | |
| 7,620,356 | B2 | 11/2009 | Moteki et al. | |
| 7,748,697 | B2 | 7/2010 | Fujita et al. | |

(Continued)

FOREIGN PATENT DOCUMENTS

| | | | |
|---|---|---|---|
| JP | H06-175524 | A | 6/1994 |
| JP | 2005-181508 | A | 7/2005 |
| JP | 2007-248790 | A | 9/2007 |

*Primary Examiner* — Anthony H Nguyen
(74) *Attorney, Agent, or Firm* — Venable LLP

(57) ABSTRACT

An image forming apparatus includes an image forming portion, first and second rotatable members, a jam detecting portion, a detector, and a controller. When a sheet to be fed to a nip is a first sheet having a first length and a first width, the controller causes the first rotatable member rotating at a first speed to feed the first sheet. When the sheet is a second sheet having is a second length shorter than the first length and having the first width, the controller causes the first rotatable member rotating at a second speed slower than the first speed to feed the second sheet. The controller stops rotation of the first rotatable member in response to detection of the occurrence of a jam by the jam detecting portion.

21 Claims, 21 Drawing Sheets

(56) References Cited

U.S. PATENT DOCUMENTS

| | | | | |
|---|---|---|---|---|
| 2003/0161649 | A1* | 8/2003 | Yoshikawa | G03G 15/1605 399/68 |
| 2007/0217839 | A1 | 9/2007 | Moteki et al. | |
| 2009/0080910 | A1* | 3/2009 | Kim | G03G 15/70 399/21 |
| 2009/0317095 | A1* | 12/2009 | Tamaoki | G03G 15/607 399/21 |

* cited by examiner

IMAGE FORMING APPARATUS

FIELD OF THE INVENTION AND RELATED ART

The present invention relates to an image forming apparatus. The image forming apparatus forms a toner image (developer image) on a sheet-like recording medium (media, recording material, sheet) by using an image forming process, such as an electrophotographic process, an electrostatic recording process or a magnetic recording process. For example, the image forming apparatus includes a copying machine, a printer (laser beam printer, LED printer or the like), a facsimile machine, a composite function machine of these machines, a word processor, and the like.

As the image forming apparatus such as the printer or the copying machine, an image forming apparatus in which the toner image formed on a photosensitive member as an image bearing member by an electrophotographic recording type is transferred onto a sheet and thereafter is fixed by a fixing device has been well known. As the fixing device, a fixing device of a type in which a sheet carrying thereon an unfixed toner image is nipped and fed through a nip (fixing nip) formed by press-contact between a fixing roller and a pressing roller which are a rotatable member pair and in which the toner image is subjected to a heat fixing process has been well known. In such an image forming apparatus, feeding failure (jam) of the sheet generates in some cases, so that a constitution for detecting the occurrence of the jam has been widely put into practical use.

Here, in the following description, "upstream" and "downstream" are those with respect to a sheet feeding direction. Japanese Laid-Open Patent Application (JP-A) 2005-181508 discloses a method in which a sheet sensor for detecting existence of the sheet is provided on a side downstream of the fixing nip and when the sheet is not detected in a predetermined time during a printing operation (image forming operation), discrimination of jam occurrence is made and then the image forming process is interrupted.

In the case where the image forming process is interrupted due to the jam occurrence, drive of the fixing device is also stopped, but in some case, a motor for driving the fixing device rotates by inertia even when the motor receives a stop instruction and thus a trailing end portion of the sheet is pulled into the fixing device. In a constitution of JP-A 2005-181508, in the case where the jam generated inside the fixing device, a degree of the pulling-in of the trailing end portion of the sheet is reduced by abruptly stopping the motor for driving the fixing device by braking the motor.

Further, in the case where the jam generated inside the fixing device, the sheet (jammed sheet) stagnating in the fixing device is removed by an operator. Further, a constitution of detecting removal of the jammed sheet by a sensor, for detecting presence or absence of the sheet, as a stagnation detecting means has been known (JP-A Hei 6-175524 and JP-A 2007-248790).

JP-A Hei 6-175524 discloses a constitution in which a remaining sheet presence or absence sensor is provided upstream of the fixing nip. Further, JP-A Hei 6-175524 discloses, as a method of detecting the removal of the jammed sheet, a type in which an operation of a lever member is detected by a photo-sensor and a type in which the presence or absence of the jammed sheet is detected by irradiating a back surface of the sheet with infrared radiation.

Further, JP-A 2007-248790 discloses a constitution in which in order to detect the trailing end portion of the sheet pulled inside the fixing device, a sensor lever is provided at a guiding portion for guiding the sheet to the fixing device.

In the image forming apparatus such as the printer or the copying machine in recent years, further speed-up is demanded, so that there is a tendency that a sheet feeding speed in the fixing device is also increased. Further, there is a tendency that a driving source and a drive transmitting device which are used for driving the fixing device are also upsized. With an increase of the sheet feeding speed in the fixing device and high inertia due to upsizing of a driving motor for driving the fixing device, a rotation amount in which the motor for driving the fixing device rotates by inertial after receiving the stop instruction increases. That is, a movement distance of the sheet from the stop instruction until sheet feeding is sufficiently stopped becomes large, so that a length in which the trailing end portion of the sheet is pulled inside the fixing device from the stop instruction until the sheet feeding is sufficiently stopped increases.

Here, in the case where a jam generated inside the fixing device is a winding jam in which the sheet winds about a rotatable fixing member (a fixing roller, for example), a leading end of the sheet does not reach the station detecting means disposed on a side downstream of the fixing nip. For that reason, in order to detect removal of the jammed sheet, it is required that the sheet is detected by the station detecting means disposed on a side upstream of the fixing nip.

However, there is a liability that due to an increase of the above-described pulling-in length of the sheet, the trailing end of the sheet stating in the fixing nip cannot be detected by the station detecting means disposed on the side upstream of the fixing nip.

SUMMARY OF THE INVENTION

A principal object of the present invention is to provide an image forming apparatus capable of reliably detecting a sheet stating in a fixing nip with occurrence of a jam.

According to an aspect of the present invention, there is provided an image forming apparatus comprising: an image forming portion configured to form a toner image on a fed sheet; first and second rotatable members configured to form a nip for fixing the toner image on the sheet while feeding the sheet fed from the image forming portion; a jam detecting portion configured to detect occurrence of a jam; a detector configured to detect the sheet remaining in the nip, at a detecting position on a side upstream of the nip with respect to a sheet feeding direction; and a controller configured to control a rotational speed of the first rotatable member depending on a length, measured in the feeding direction, of the sheet to be fed to the nip, wherein when the sheet to be fed to the nip is a first sheet having a first length measured in the feeding direction and having a first width measured in a widthwise direction perpendicular to the feeding direction, the controller causes the first rotatable member rotating at a first speed to feed the first sheet, and when the sheet to be fed to the nip is a second sheet having a second length measured in the feeding direction shorter than the first length and having the first width measured in the widthwise direction, the controller causes the first rotatable member rotating at a second speed slower than the first speed to feed the second sheet, and wherein the controller stops rotation of the first rotatable member in response to detection of the occurrence of the jam by the jam detecting portion.

According to another aspect of the present invention, there is provided an image forming apparatus comprising: an image forming portion configured to form a toner image on a fed sheet; first and second rotatable members configured to form a nip for fixing the toner image on the sheet while feeding the sheet fed from the image forming portion; a jam detecting portion configured to detect occurrence of a jam; a detector configured to detect the sheet remaining in the nip, at a detecting position on a side upstream of the nip with respect to a sheet feeding direction; and a controller configured to stop rotation of the first rotatable member in response to detection of the occurrence of the jam by the jam detecting portion, wherein when a first sheet having a first length measured in the feeding direction, having a first width measured in a widthwise direction perpendicular to the feeding direction, and having a first basis weight, the first rotatable member feeds the first sheet while rotating at a first speed, and when a second sheet having a second length measured in the feeding direction shorter than the first length, having the first width measured in the widthwise direction, and having the first basis weight, the first rotatable member feeds the second sheet while rotating at a second speed slower than the first speed.

According to a further aspect of the present invention, there is provided an image forming apparatus comprising: an accommodating portion configured to accommodate a sheet on which a toner image is to be formed; an image forming portion configured to form a toner image on a sheet fed from the accommodating portion; first and second rotatable members configured to form a nip for fixing the toner image on the sheet while feeding the sheet fed from the image forming portion; a jam detecting portion configured to detect occurrence of a jam; a detector configured to detect the sheet remaining in the nip, at a detecting position on a side upstream of the nip with respect to a sheet feeding direction; and a rotation controller configured to control a rotational speed of the first rotatable member depending on a length, measured in the feeding direction, of the sheet to be fed to the nip, wherein the rotation controller stops the rotation of the first rotatable member in response to detection of the occurrence of the jam by the jam detecting portion; and a registration controller configured to register information of the sheet accommodated in the accommodating portion in association with the accommodating portion; wherein the registration controller permits registration of a first sheet having a first length measured in the feeding direction and having a first basis weight, in association with the accommodating portion, permits registration of a second sheet having the first length and having a second basis weight smaller than the first basis weight, in association with the accommodating portion, permits registration of a third sheet having a second length measured in the feeding direction shorter than the first length and having the first basis weight in association with the accommodating portion, and prohibits registration of a fourth sheet having the second length and having the second basis weight, in association with the accommodating portion.

Further features of the present invention will become apparent from the following description of exemplary embodiments with reference to the attached drawings.

BRIEF DESCRIPTION OF THE DRAWINGS

Parts (a) to (c) of FIG. 1 are schematic views of an example of a sheet length and a sensor arrangement in a fixing device in Embodiment 1.

Figure 5:
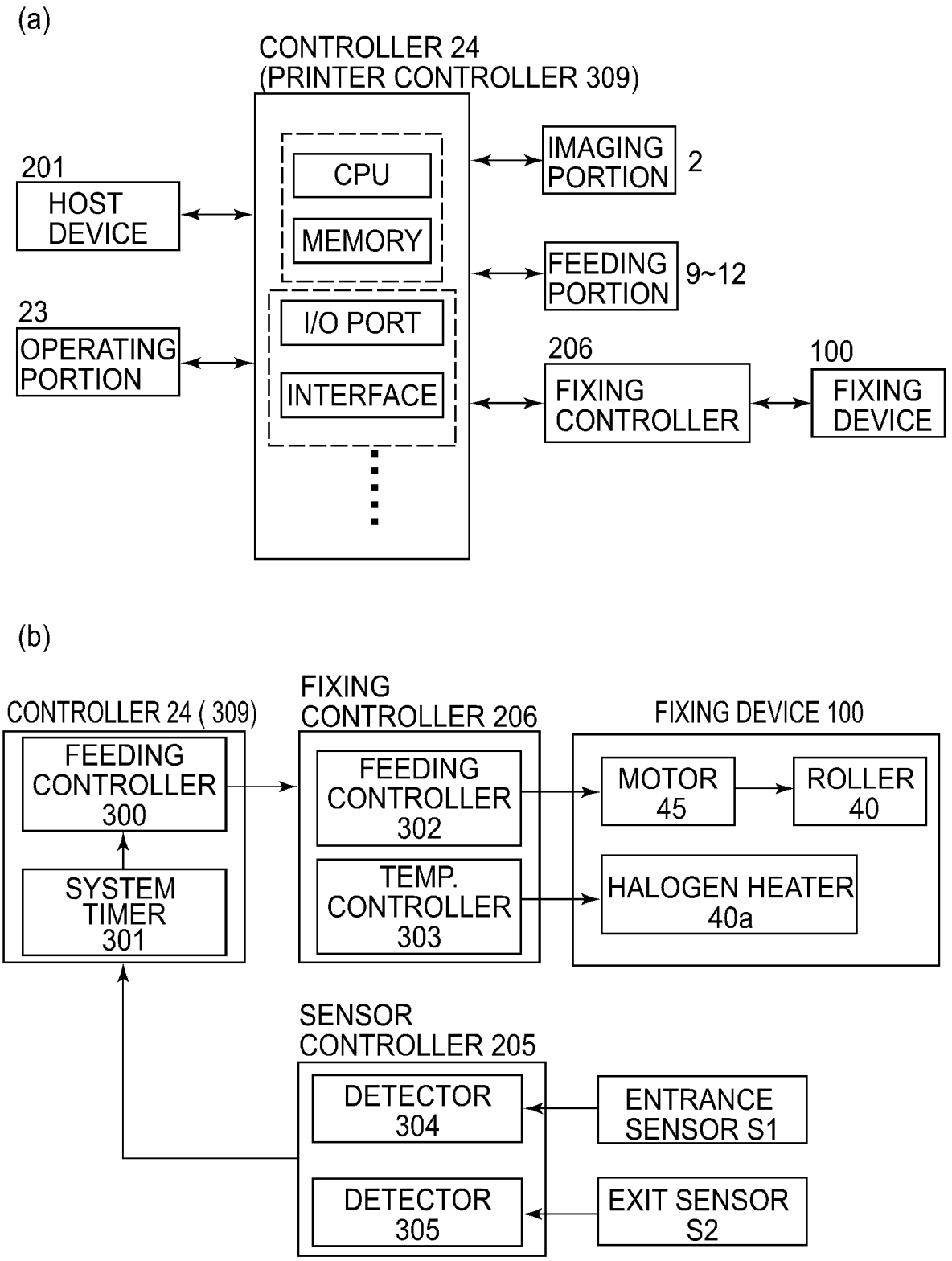

Parts (a) and (b) of FIG. 5 are block diagrams of a control system example of the image forming apparatus.

Figure 6:
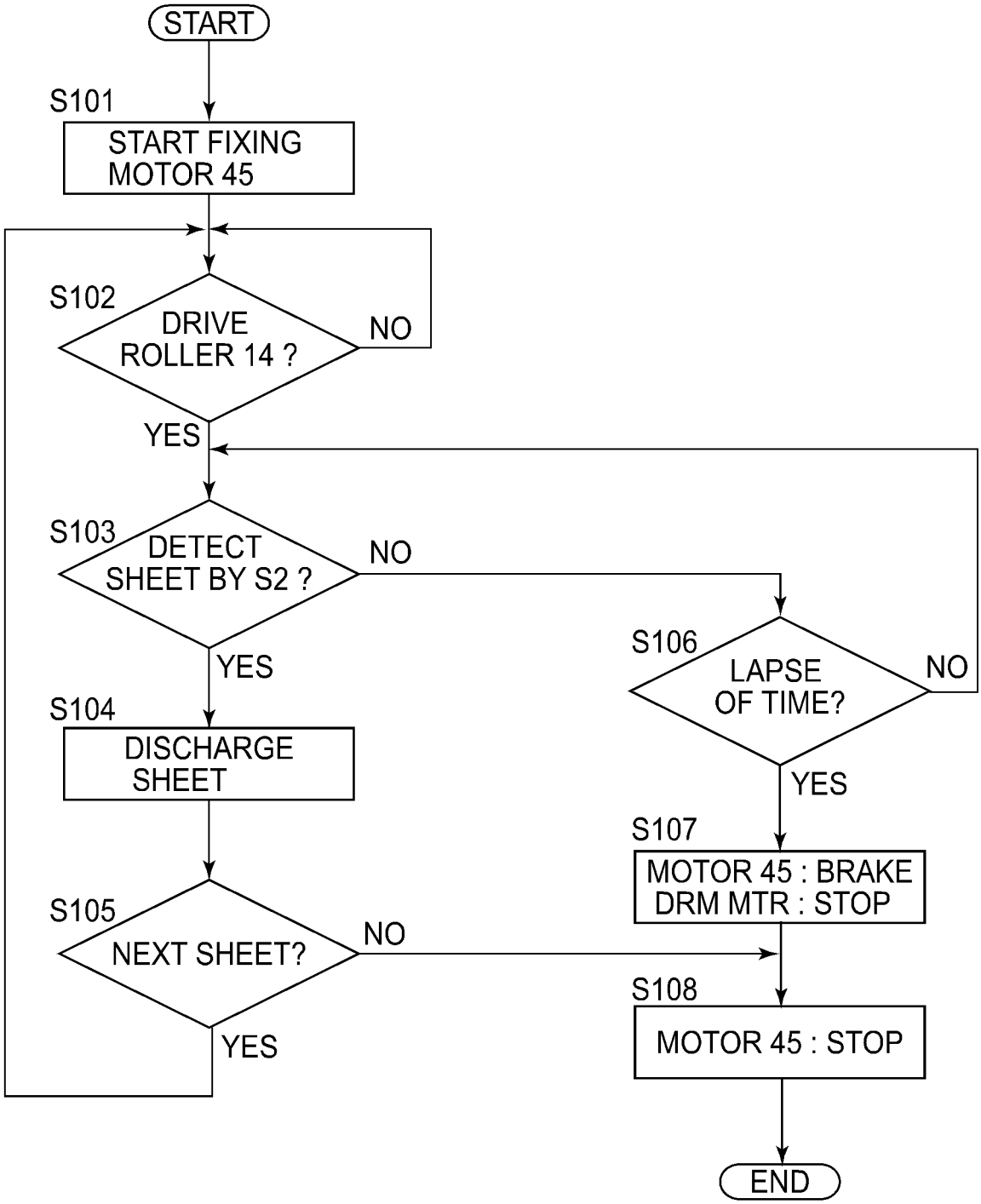

FIG. 6 is a flowchart for illustrating a jam detecting operation.

Figure 7:
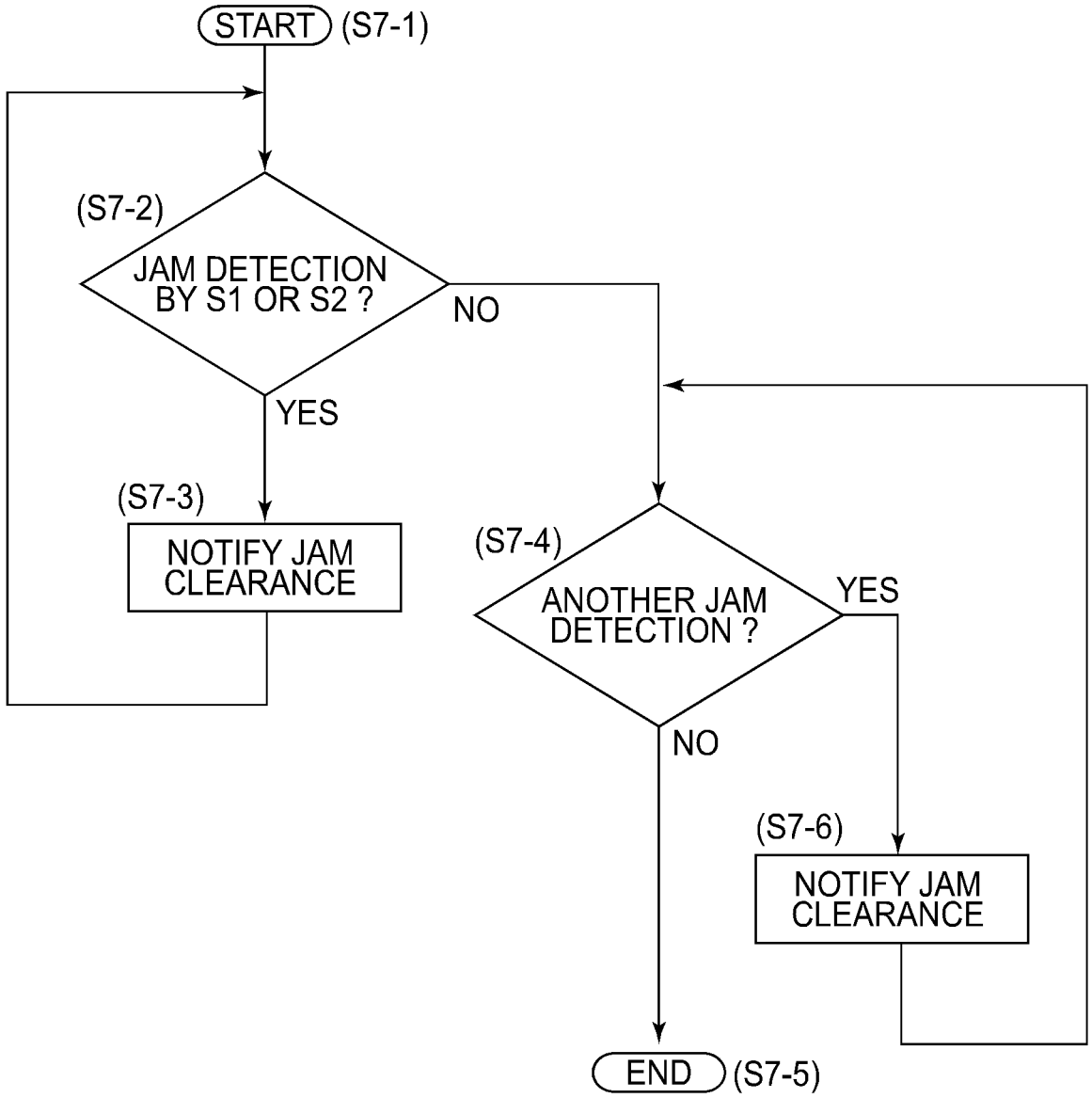

FIG. 7 is a flowchart for illustrating a jam cleaning operation.

Figure 8:
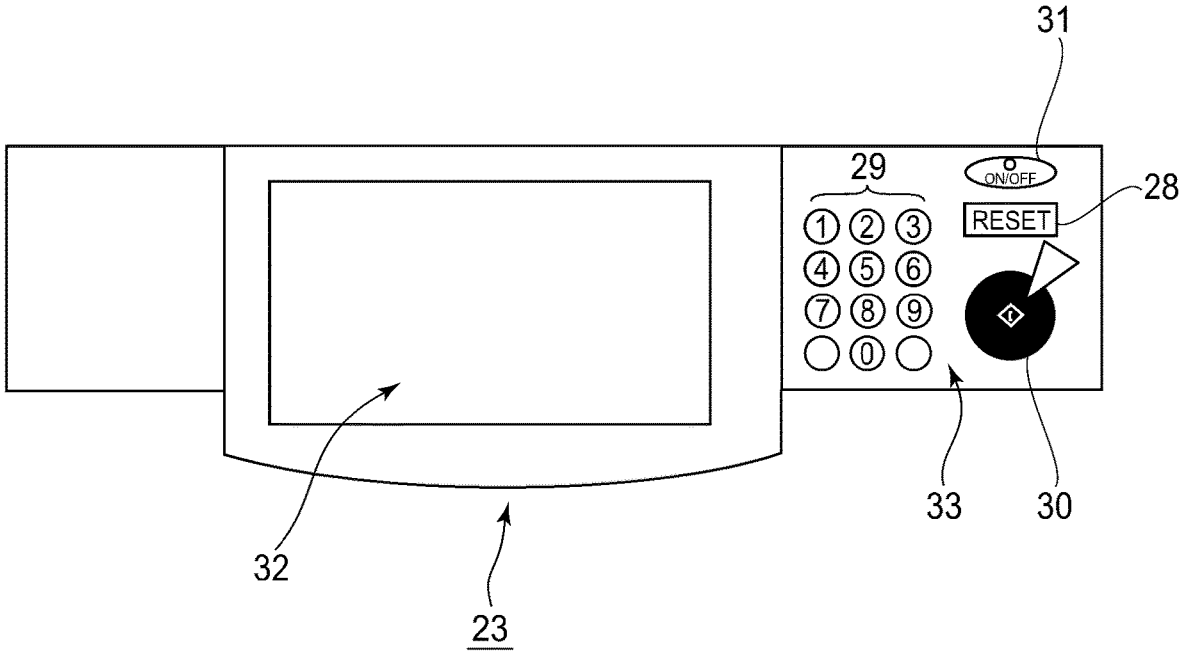

FIG. 8 is a schematic view of an example of an operating portion.

Figure 9A:
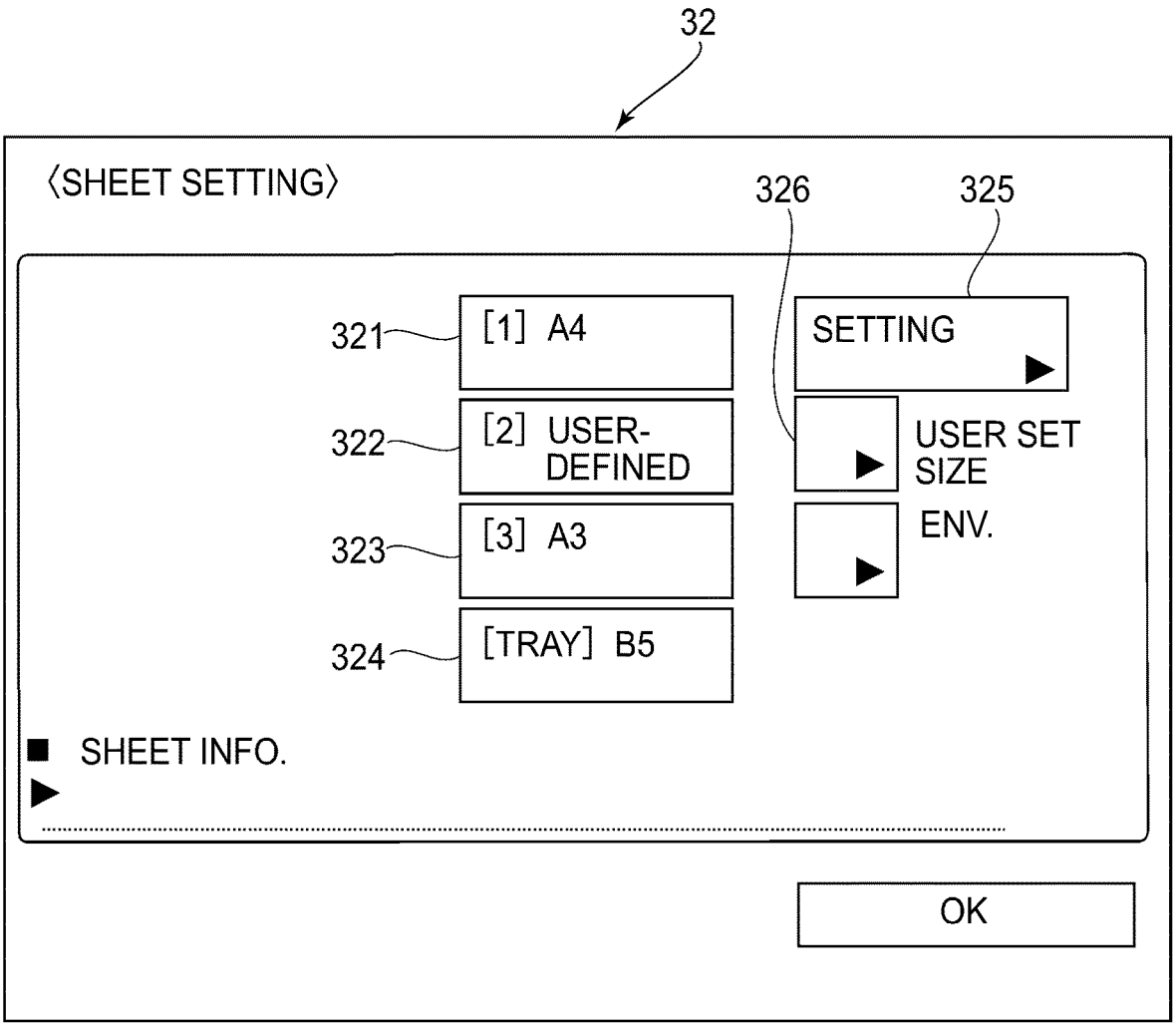

FIG. 9A is a schematic view of an example of a sheet setting screen.

Figure 9B:
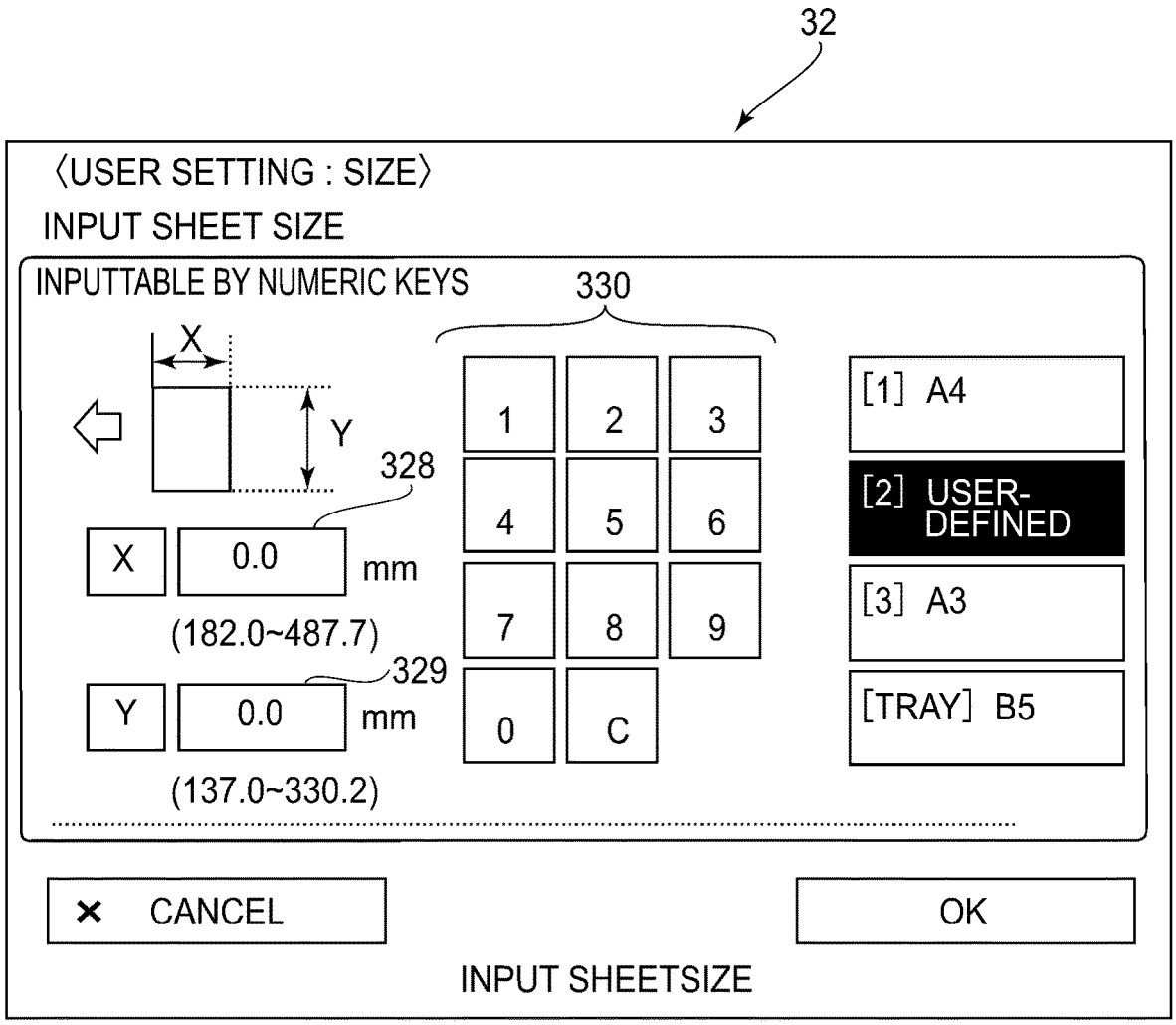

FIG. 9B is a schematic view of an example of a sheet size setting screen.

Figure 9C:
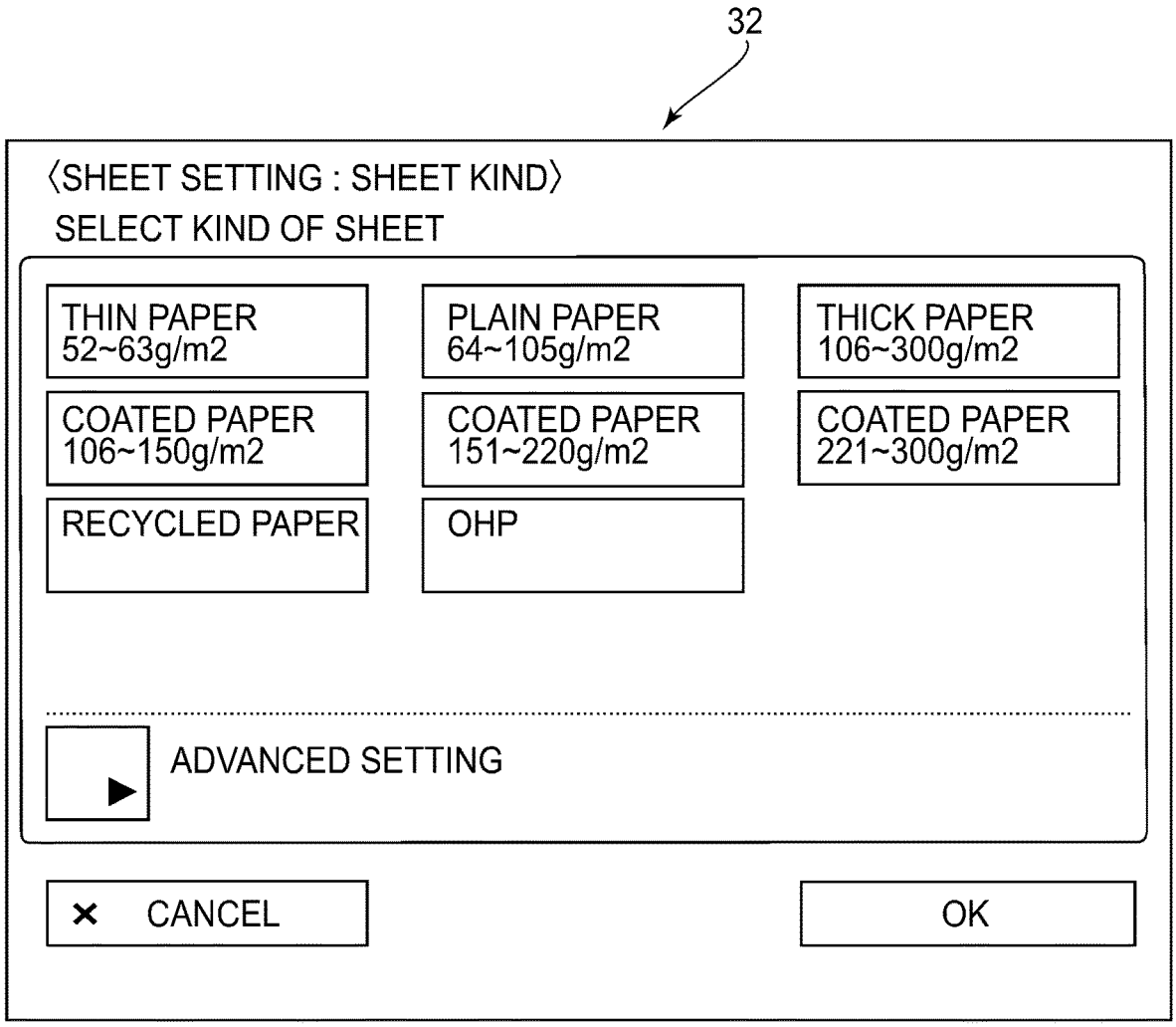

FIG. 9C is a schematic view of an example of a sheet kind setting screen.

Figure 10:
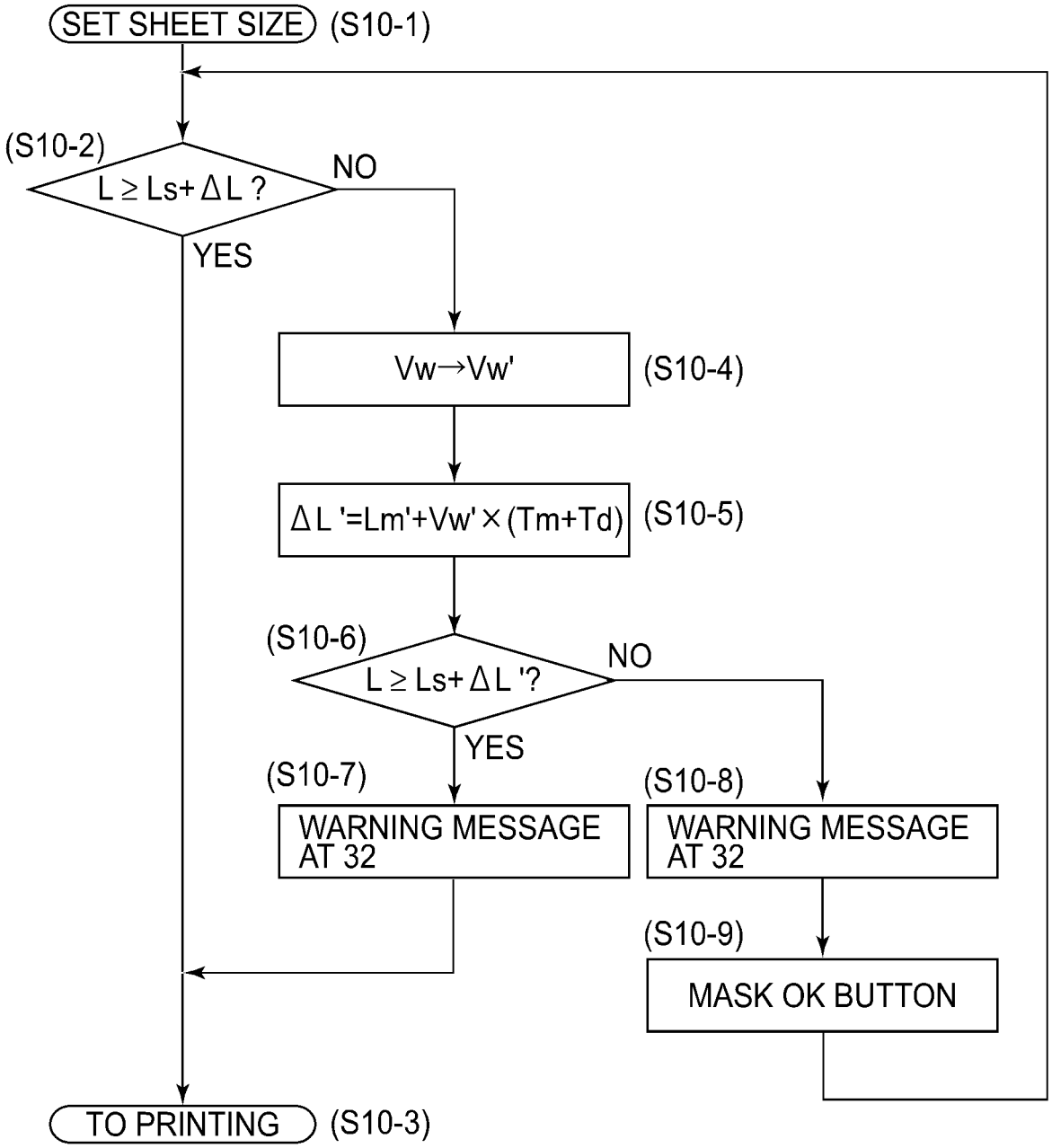

FIG. 10 is a flowchart of a printing operation in Embodiment 1.

Figure 11:
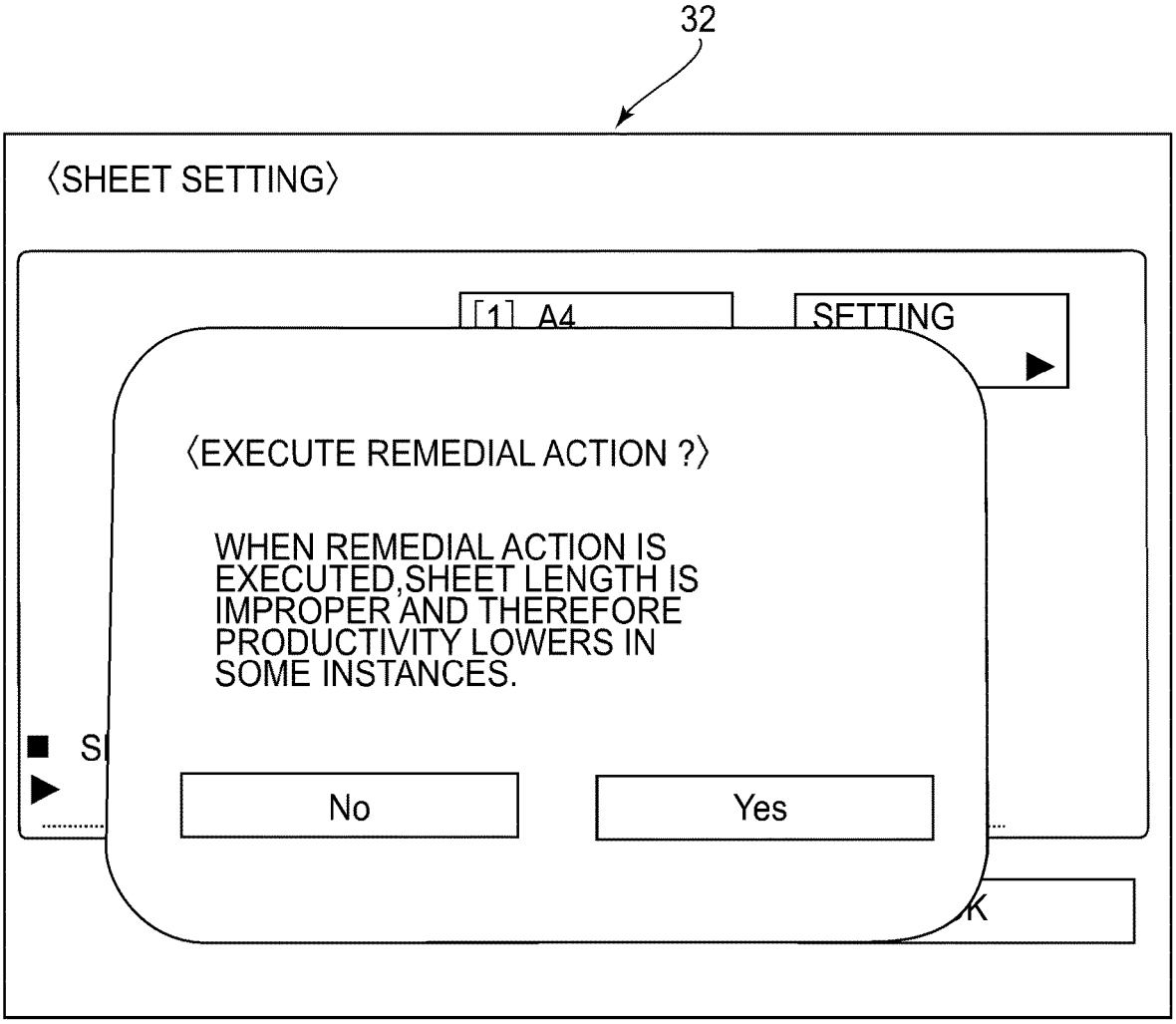

FIG. 11 is a schematic view of an example of a notifying screen.

Figure 12:
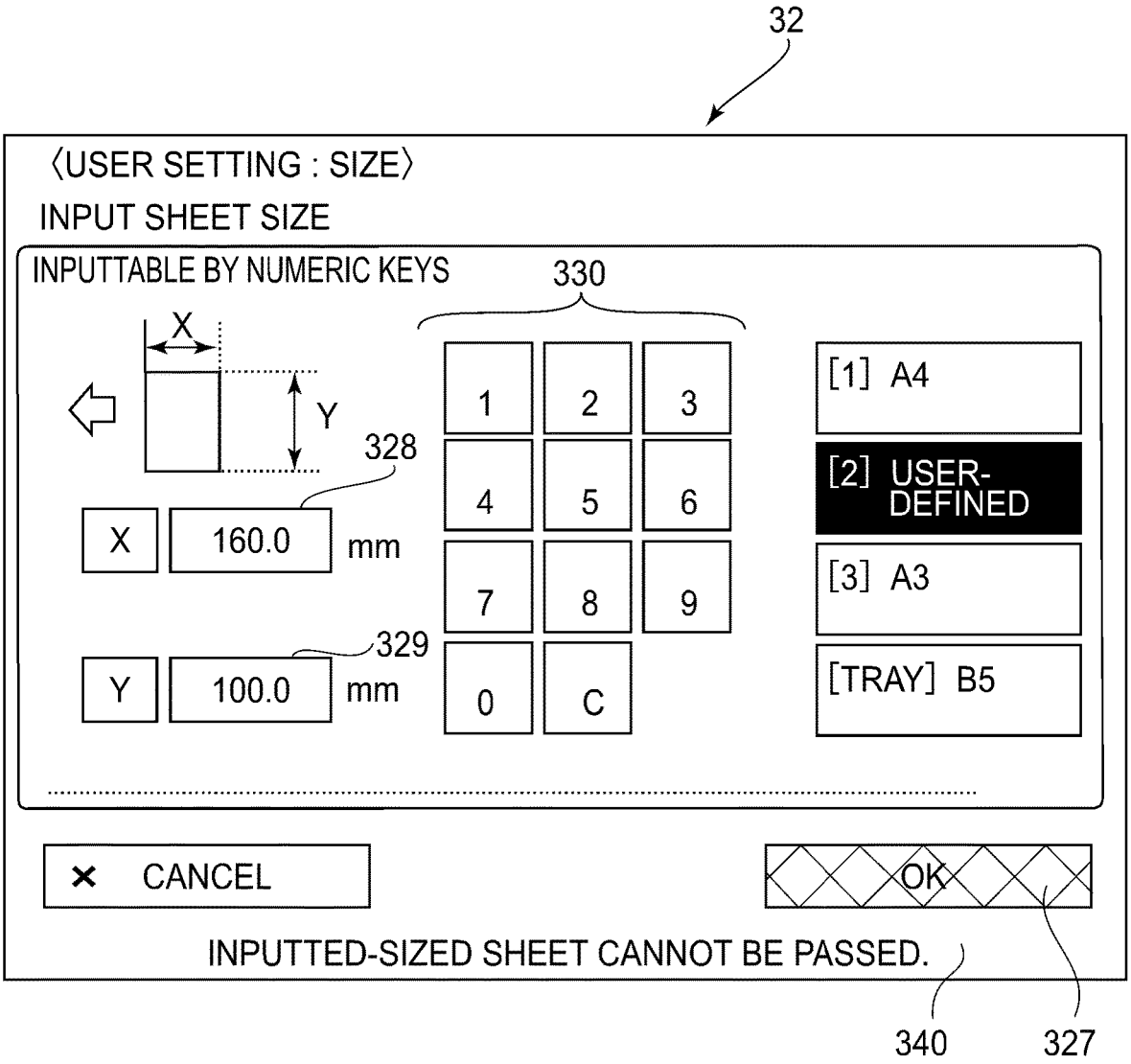

FIG. 12 is a schematic view of another example of the notifying screen.

Figure 13:
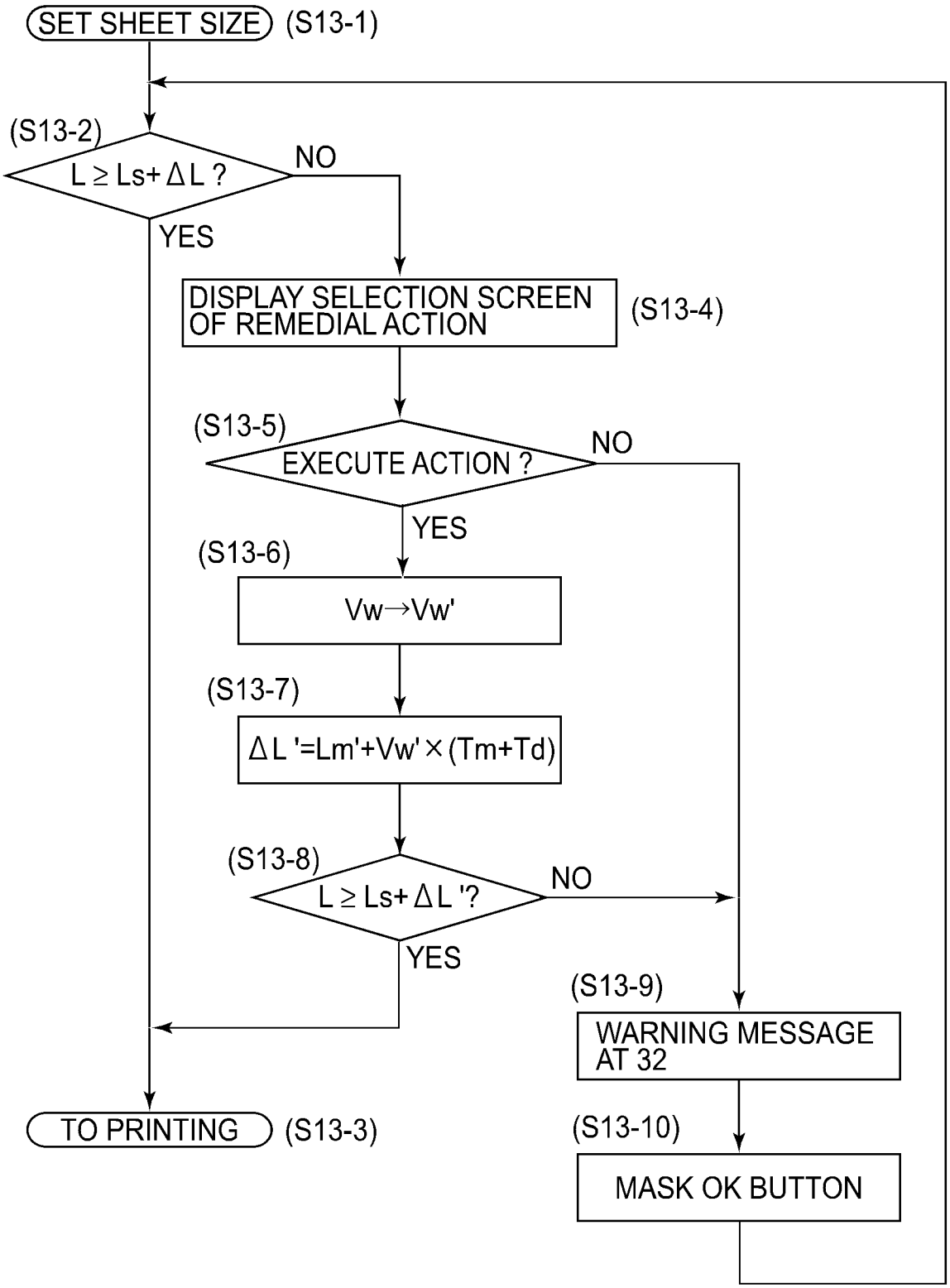

FIG. 13 is another flowchart of the printing operation in Embodiment 1.

Figure 14:
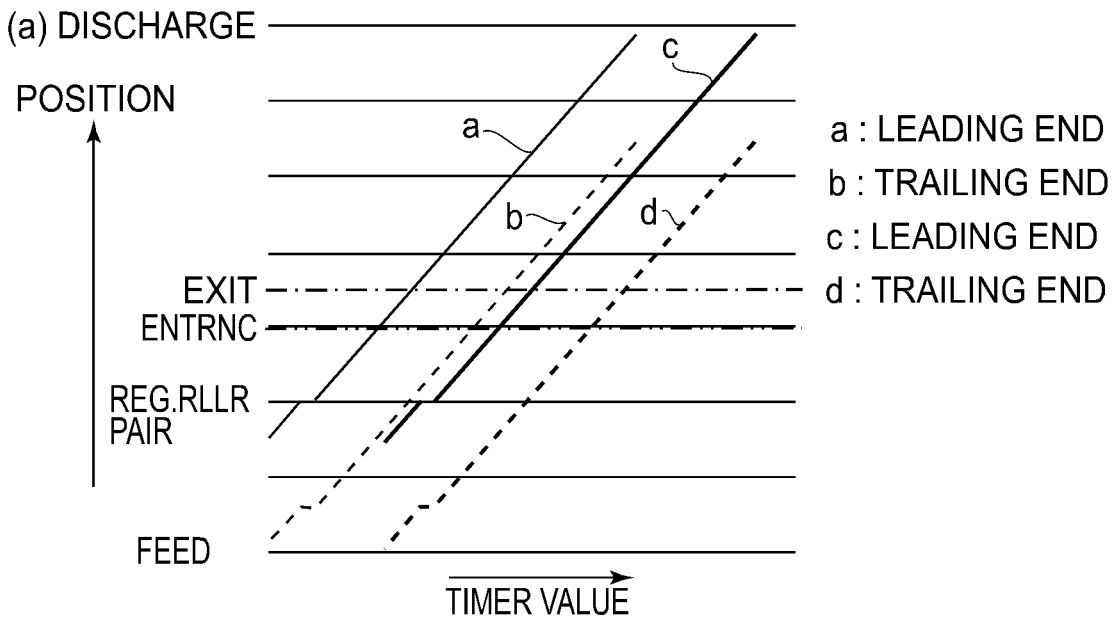
Figure 14:
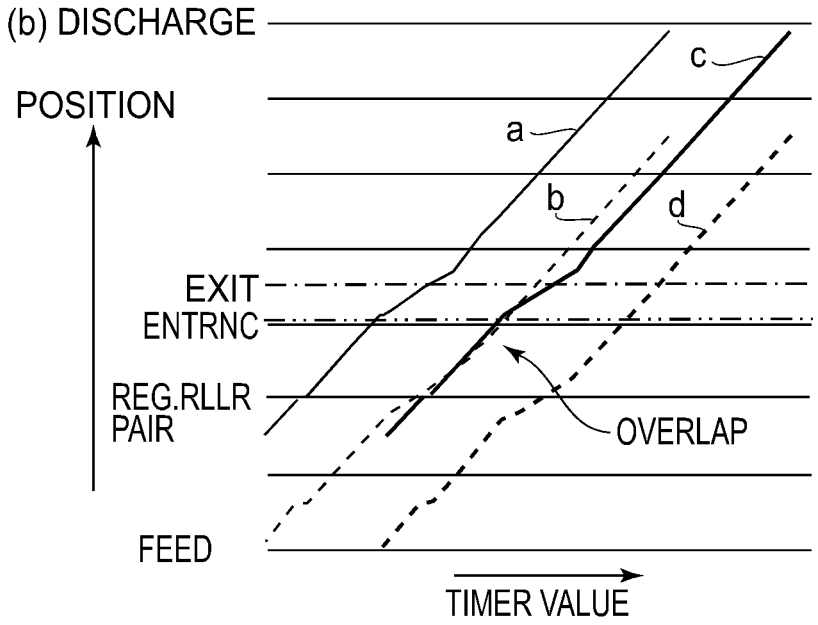

Parts (a) and (b) of FIG. 14 are diagram charts.

Figure 15:
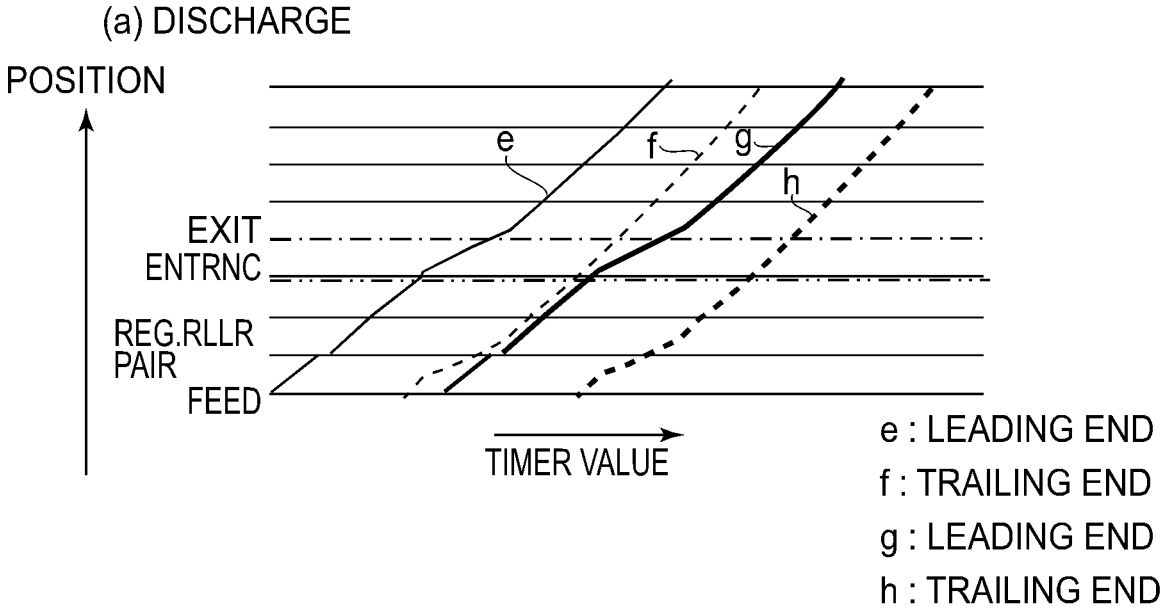
Figure 15:
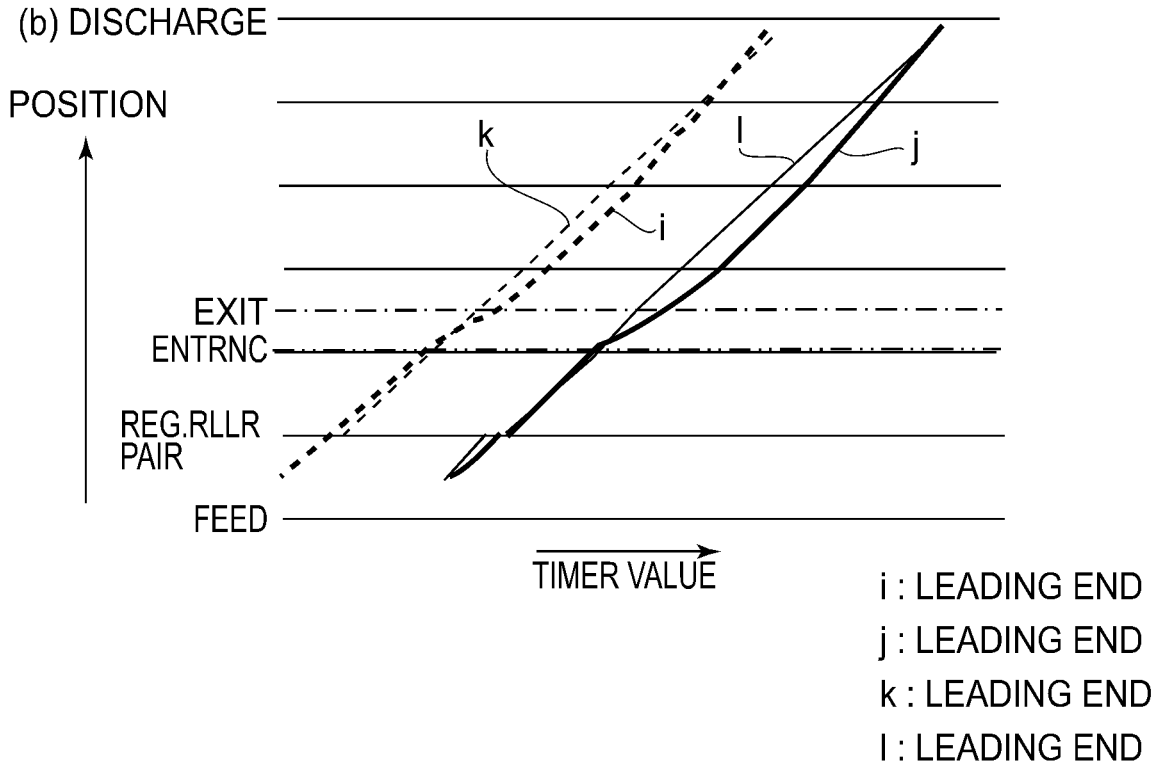

Parts (a) and (b) of FIG. 15 are diagram charts.

Figure 16:
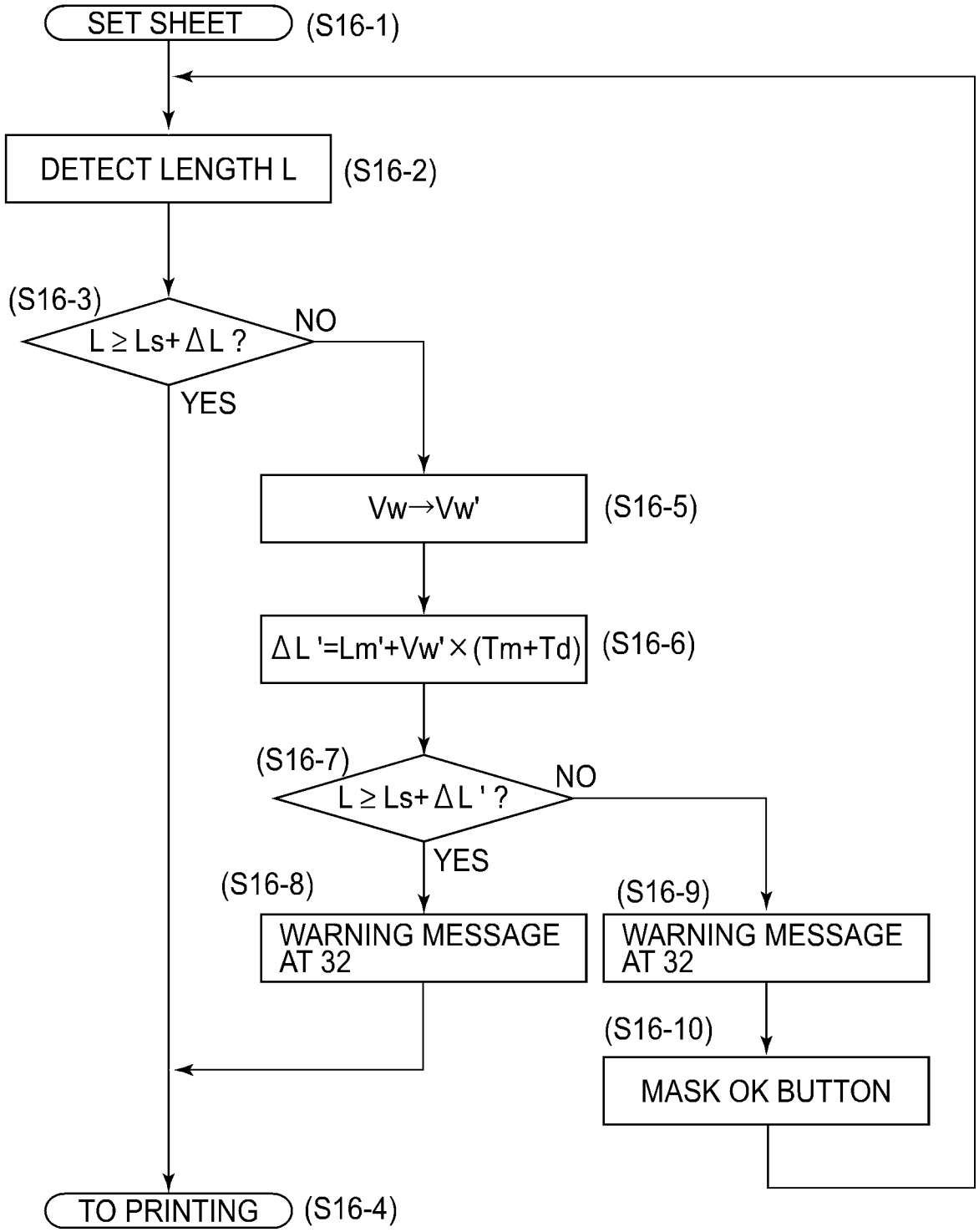

FIG. 16 is a flowchart of a printing operation in Embodiment 2.

Figure 17:
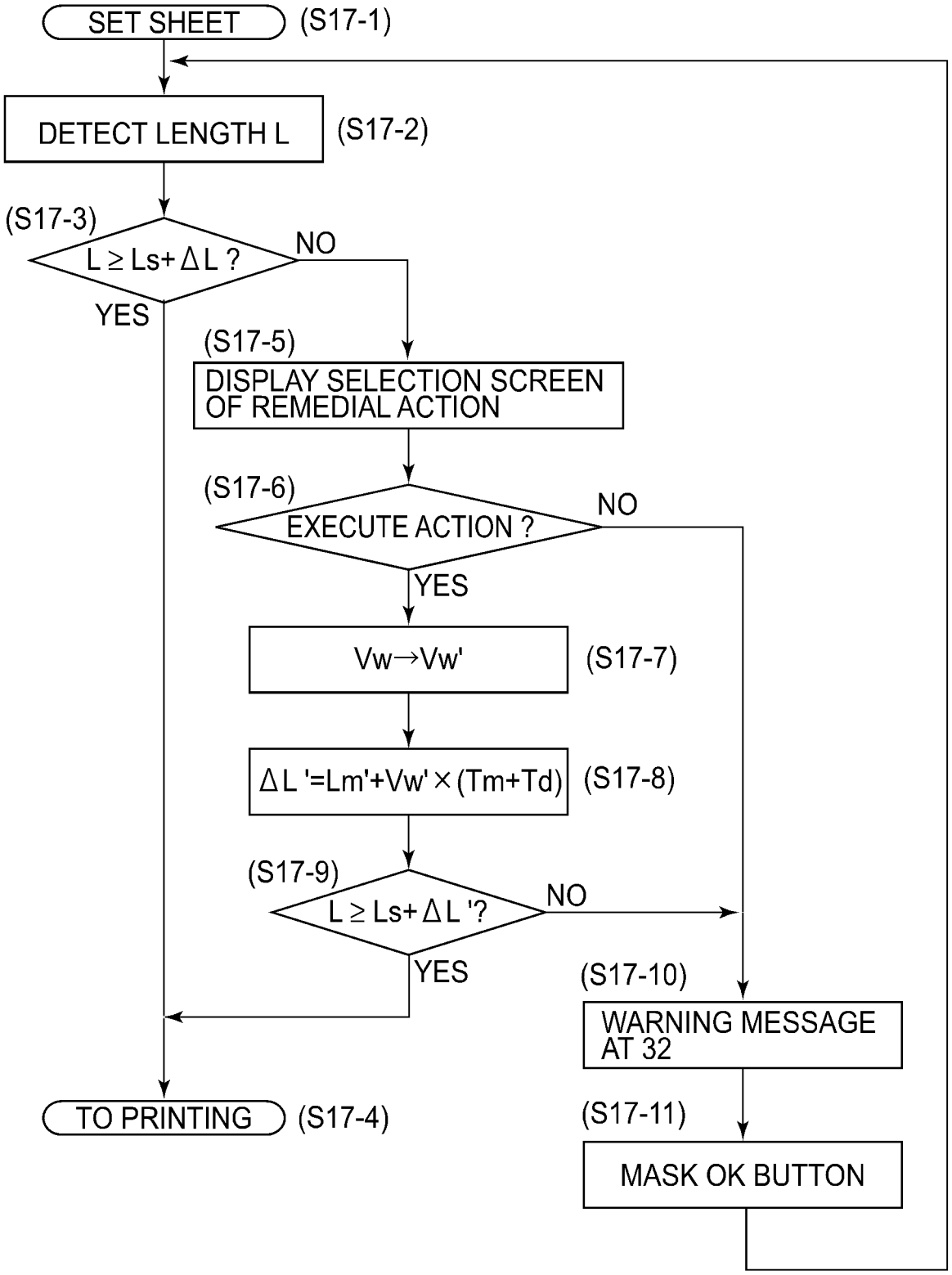

FIG. 17 is another flowchart of the printing operation in Embodiment 2.

Figure 18:
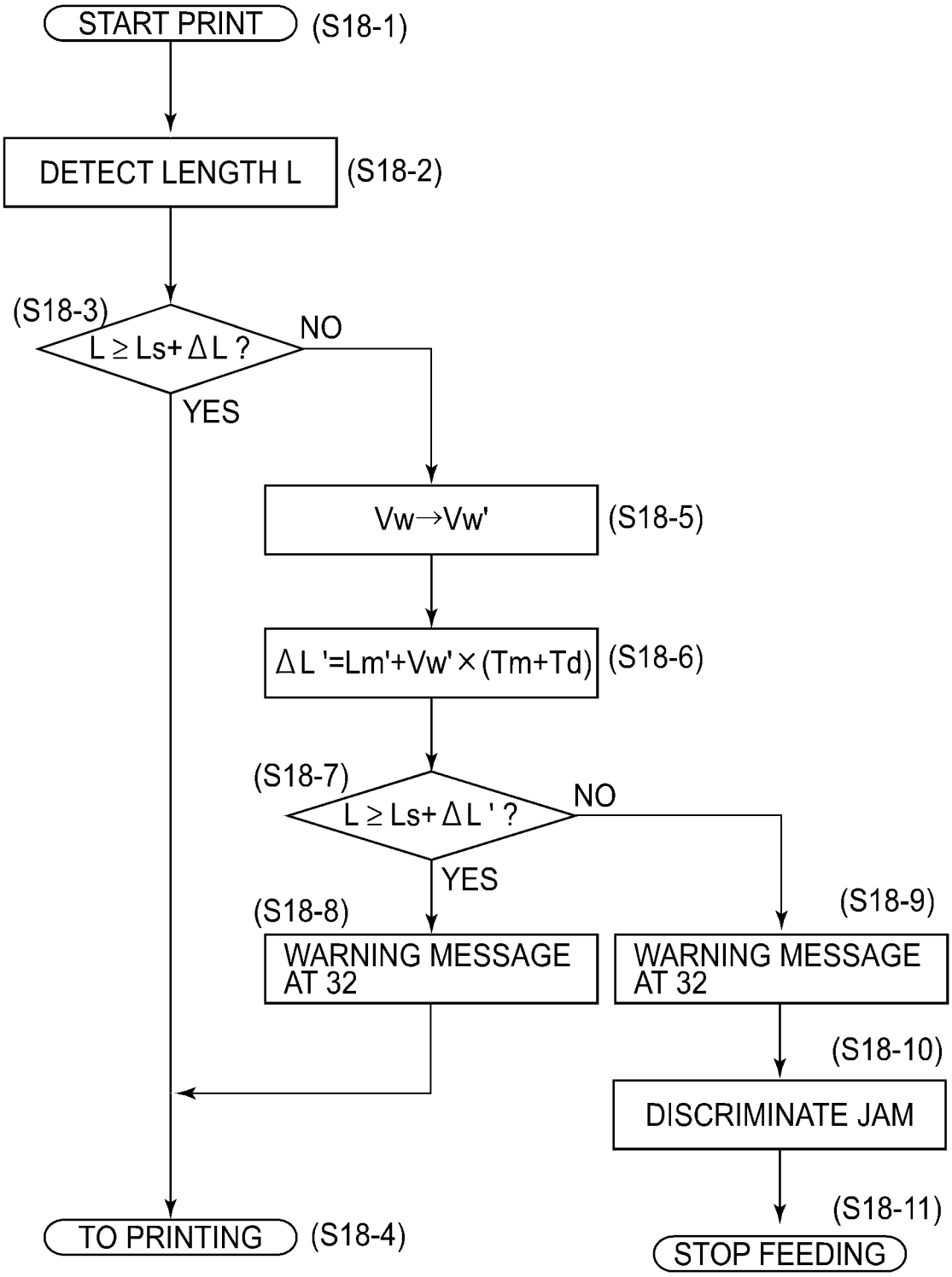

FIG. 18 is a flowchart of a printing operation in Embodiment 3.

Figure 19:
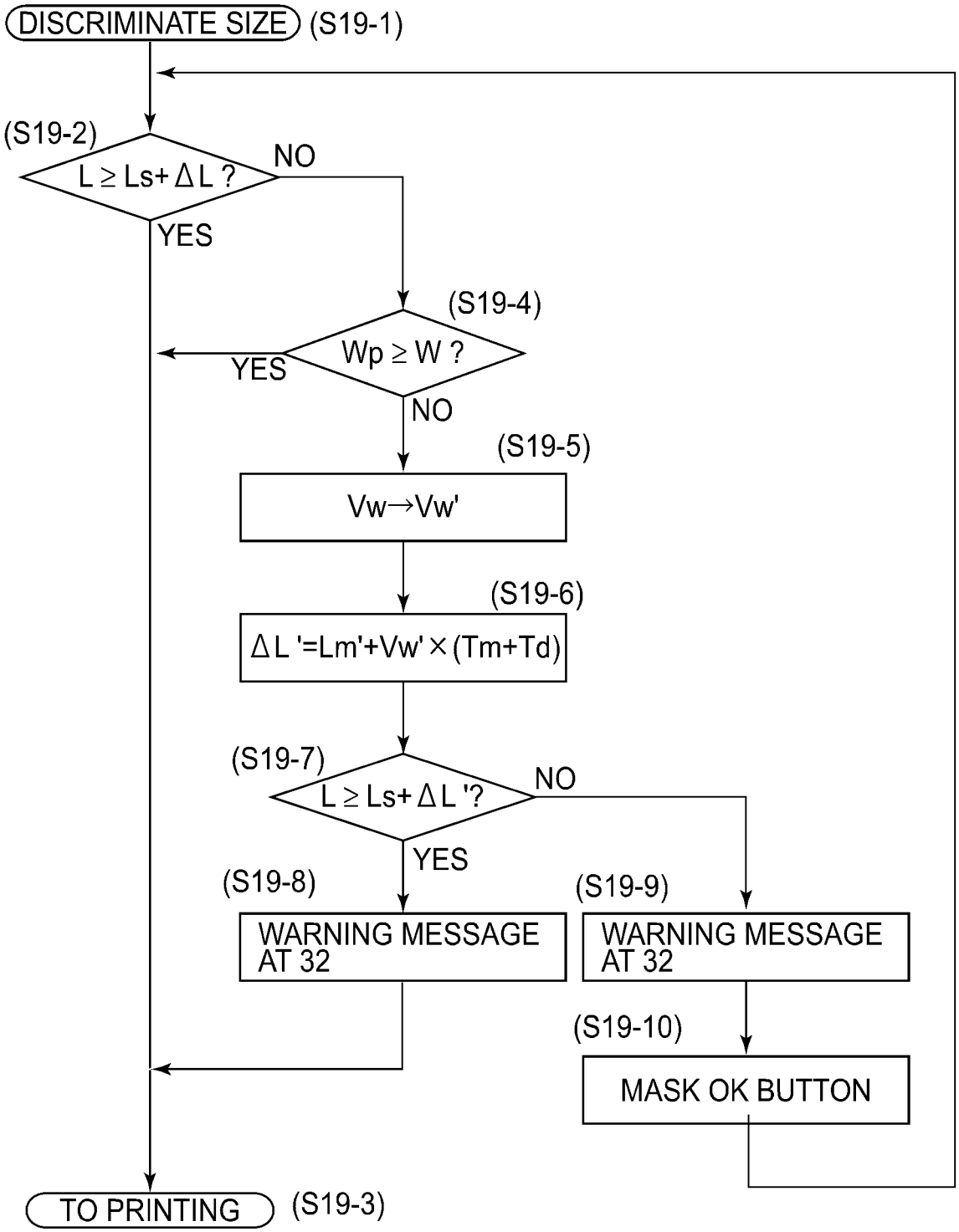

FIG. 19 is a flowchart of a printing operation in Embodiment 4.

DETAILED DESCRIPTION OF EMBODIMENTS

Embodiment 1

(Image Forming Portion)

Figure 2:
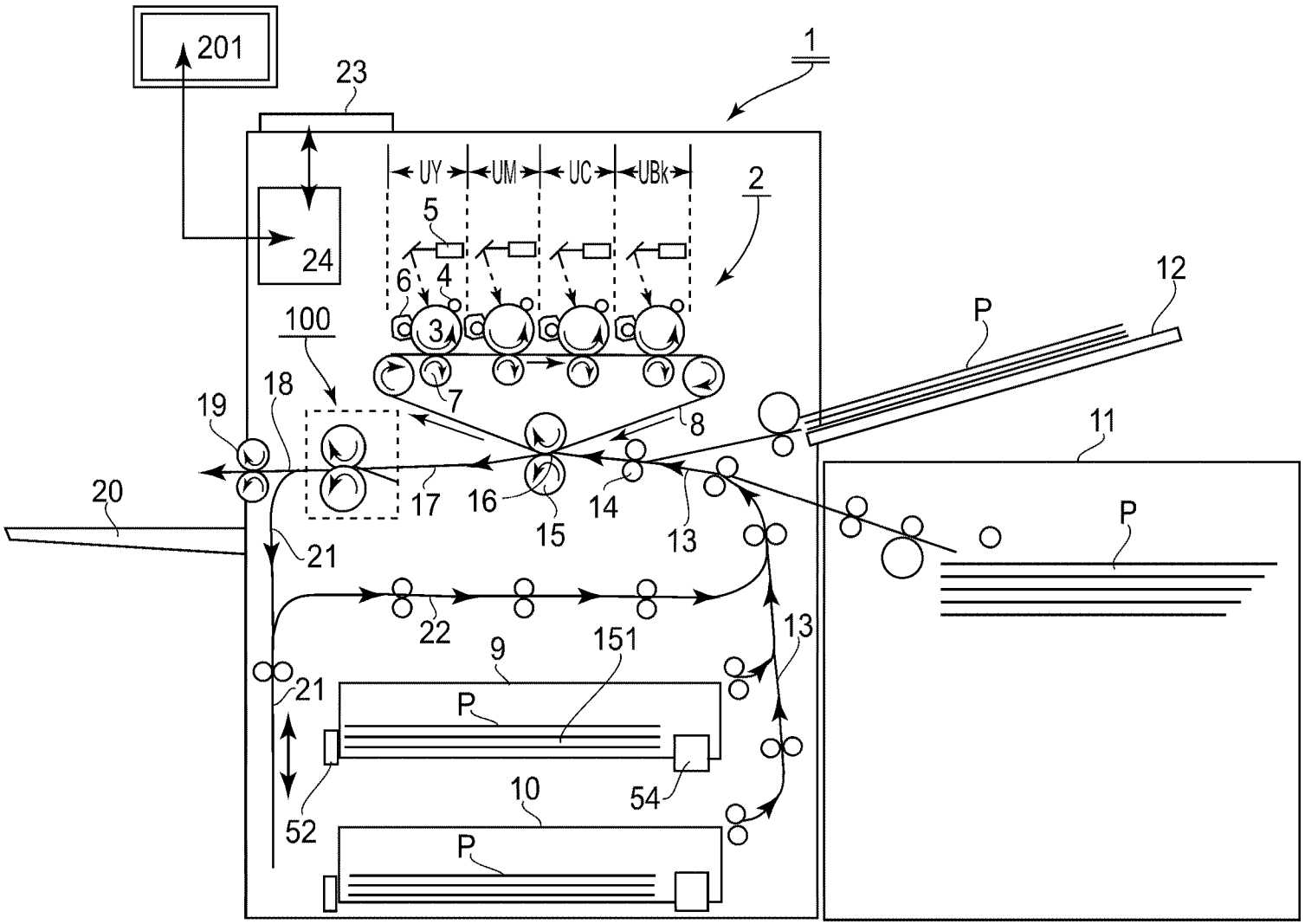
FIG. 2 is a schematic view of a structure of an image forming apparatus of Embodiment 1.

FIG. 2 is a schematic view of a structure of an image forming apparatus 1 in this embodiment. This image forming apparatus is a four-color based full-color laser beam printer of an electrophotographic type, a tandem type and an intermediary transfer type. The printer 1 prints out a full-color or monochromatic image-formed product by carrying out a printing operation (image forming operation, print operation) corresponding to a printing job (image forming job, print job) inputted from a host device 201 to a controller 24.

A sheet-like recording medium (media, recording material, sheet) on which a toner image can be formed by the image forming apparatus includes, for example, plan paper, thick paper, an envelope, a postcard, a seal, a resinous sheet, an overhead projector sheet (OHT sheet) and the like. In the following description, as an example of the recording medium on which the toner image is to be formed, a sheet is referred to. Further, paper (sheet)-related terms such as sheet (paper) passing, sheet (paper) feeding, sheet (paper) discharge and the like are described, but a material is not limited to the sheet (paper).

The host device 201 is a personal computer, an image reader, a facsimile machine, a network or the like. The print job is an image forming instruction to which printing condition information such as image data, a kind of a designated sheet, a basis weight of the sheet, a size of the sheet, the number of sheets, the number of prints, a layout, a post-process or the like is added.

An operating portion (user interface) 23 for inputting various pieces of information to the controller 24 is provided and includes a display portion (notifying portion) 32 (FIG. 8) and an operation inputting portion 33 as described later. The controller 24 conducts control of all of devices of the printer 1 and control of a sequence of the printing operation as described later (FIG. 5).

An image forming portion 2 for forming toner images on a fed sheet P includes four image forming units U (Y, M, C, Bk) for forming the toner images of four colors consisting of three primary colors of yellow (Y), magenta (M) and cyan (C) for subtractive color mixture and consisting of black (Bk) added to the three primary colors. Further, the image forming unit 2 includes an endless intermediary transfer belt 8.

Each of the image forming units U includes electrophotographic process devices such as a photosensitive drum 3, a charging roller 4, a laser scanner 5, a developing device 6, and a primary transfer roller 7. In order to avoid complication of FIG. 2, indication of reference numerals or symbols of these devices in the image forming units UM, UC and UBk other than the image forming unit UK were omitted.

In the case of a full-color mode (operation), the respective image forming units U from the toner images of Y, M, C and Bk on the associated photosensitive drums 3. Incidentally, electrophotographic principle and process are well known and therefore description thereof will be omitted. The four color toner images described above are successively primary-transferred superposedly in a predetermined manner from the photosensitive drums 3 onto a belt 8. As a result, on the belt 8, superposed color toner images of the four colors of Y+M+C+Bk are formed.

The toner images formed on the belt 8 are secondary-transferred onto the sheet P at a secondary transfer portion 16 which is a press-contact nip between the belt 8 and a secondary transfer roller 15. A single sheet P is separated and fed from either one of a first sheet feeding cassette 9, a second sheet feeding cassette 10, a large-capacity sheet feeding device 11 and a manual feeding tray 12 which are sheet feeding portions (sheet accommodating portions) and passes through a feeding path 13, and then is fed to a registration roller pair 14.

The registration roller pair 14 once receives a leading end portion of the sheet P, and in the case where the sheet P obliquely moves, rectifies a movement direction straight. Then, the registration roller pair 14 is driven at predetermined control timing in synchronism with the toner images on the belt 8. By this drive of the registration roller pair 14, the sheet P is fed to the secondary transfer portion 16, and the toner images are successively secondary-transferred from the belt 8 onto the sheet P. The sheet P passed through the secondary transfer portion 16 passes through a feeding path 17 and is guided into a fixing device (fixing portion) 100, in which the toner images are fixed on the sheet P under application of heat and pressure.

The sheet P coming out of the fixing device 100 passes through an upper side of a flapper 18 in the case of a one-side printing mode (operation), and is fed and discharged as a product of one-side printing on a discharge tray 20 by a discharging roller pair 19.

In the case of a double-side printing mode (operation), the sheet P which came out of the fixing device 100 and on which one surface the toner images were printed is guided to a reverse feeding path 21 by the flapper 18 and is fed in a switch-back manner, and then is guided to a feeding path 22 for double-side printing. Then, the sheet P passes from the feeding path 22 through the feeding path 13 again. Thereafter, similarly as in the case of the one-side printing mode, the sheet P passes through a path including the feeding path 17, the fixing device 100, the upper side of the flapper 18 and the discharging roller pair 19 and is fed and discharged as a product of the double-side printing on the discharge tray 20.

In the case of a monochromatic color mode (operation), of the above-described four image forming units, only the image forming unit necessary to form a designated monochromatic (single color) image performs an image forming operation, and in other image forming units, the photosensitive drums 3 are idled.

(Fixing Device)

Figure 3:
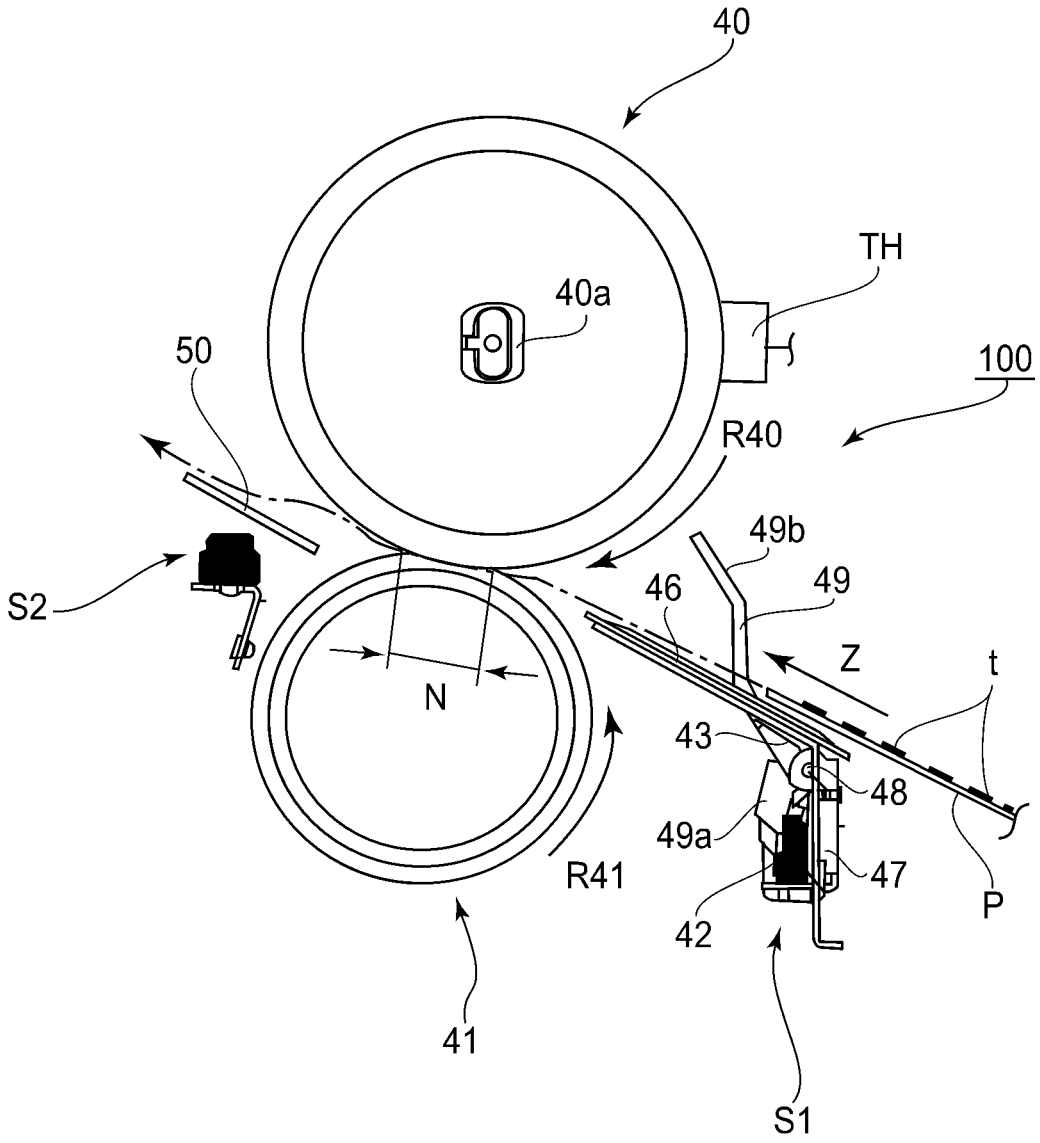
FIG. 3 is a schematic cross-sectional view of a principal part of the fixing device in Embodiment 1.

FIG. 3 is a schematic cross-sectional view of a principal part of the fixing device (fixing portion) 100 in this embodiment. Here, in the following description, "upstream" and "downstream" are those with respect to a sheet feeding direction Z.

This fixing device 100 includes a fixing roller (first rotatable member, heating member) 40 and a pressing roller (second rotatable member, pressing member) 41 which constitute a rotatable member pair. The fixing roller 40 and the pressing roller 41 cooperate with each other and form a nip (heating nip, fixing nip) where the sheet P from the image forming portion 2 is nipped and fed by a rotating operation and toner images t on the sheet P are heated and fixed.

The fixing roller 40 is constituted in a diameter of 60 mm by forming a 3 mm-thick elastic layer on an outer peripheral surface of a cylindrical core metal made of aluminum. The elastic layer is a HTV (high-temperature vulcanization type) silicone rubber layer. As an outermost layer, a fluorine-containing resin layer is provided.

The pressing roller 41 is constituted in a diameter of 45 mm by forming a 1 mm-thick elastic layer on an outer peripheral surface of a cylindrical core metal made of aluminum. A layer under the elastic layer is the HTV silicone rubber layer. On an outer peripheral surface of the HTV silicone rubber layer, a fluorine-containing resin layer is provided.

The fixing roller 40 and the pressing roller 41 are vertically disposed in substantially parallel to each other, and both end portions thereof are rotatably supported through bearing members (ball bearings) between side plates of a fixing device frame (not shown) on one side and the other side. Further, the pressing roller 41 is disposed so as to be movable toward and away from the fixing roller 40 and is press-contacted to the fixing roller 40 by a press-contact mechanism (not shown) with a predetermined pressing force (pressure), so that the nip N having a predetermined width is formed, with respect to the feeding direction Z of the sheet P, between the pressing roller 41 and the fixing roller 40. In this embodiment, the pressing roller 41 is press-contacted to the fixing roller 40 with a total pressure of about 784 N (about 80 kg).

Further, during a stand-by state of the printer 1, the pressing roller 41 is moved in a direction of being spaced by a pressure-releasing mechanism (not shown) from the fixing roller 40 against the pressing force of the press-contact mechanism, and is maintained in a state in which formation of the nip N is eliminated.

At a central portion inside the fixing roller 40, a halogen heater 40*a* as a heating source is non-rotatably provided. This heater 40*a* is turned on, whereby the fixing roller 40 is heated from an inside of the fixing roller 40. A surface temperature of the fixing roller 40 is detected by a thermistor TH as a temperature sensor, and its detection temperature information is fed back to the controller 24. The controller 24 controls supply electric power to the heater 40*a* on the basis of the detection temperature information inputted thereto and thus carries out the control so that the surface temperature of the fixing roller 40 falls within a predetermined range.

The fixing roller 40 and the pressing roller 41 are connected with each other by a gear mechanism (not shown) including gears fixed to shaft end portions thereof on one side, and to the gear mechanism, a driving force of a fixing motor 45 (part (b) of FIG. 5) described later is transmitted. By this drive transmission, the fixing roller 40 and the pressing roller 41 are rotated in an arrow R40 direction and an arrow R41 direction, respectively, at a predetermined speed.

At a portion upstream of the nip N, a first sheet guide (hereinafter referred to as an "entrance guide") 46 is provided so as to guide a sheet leading end to the nip N. Further, at a portion downstream of the nip N, a second sheet guide (hereinafter referred to as an "exit guide" 50 is provided. The exit guide 50 is disposed so as to guide the sheet P, coming out of the nip N and separated from the fixing roller 40, in a direction in which the sheet P is discharged from the fixing device 100.

During the printing operation of the printer 1, in the fixing device 100, the pressing roller 41 is press-contacted to the fixing roller 40 and thus the nip N is formed. Further, the fixing roller 40 and the pressing roller 41 are rotationally driven in the arrow R40 direction and the arrow R41 direction, respectively, at the predetermined speed. Further, the fixing roller 40 is heated, and the surface temperature thereof is controlled so as to fall within a predetermined range.

In this state of the fixing device, from the image forming portion 2 side, the sheet P carrying the toner images t thereon is guided to the nip N by the entrance guide 46. The sheet P is nipped and fed through the nip N in contact with the fixing roller 40 at an image surface thereof, so that the toner images t are heat-fixed. The sheet P coming out of the nip N is separated from the surface of the fixing roller 40 and is guided by the exit guide 50 and gradually goes out from the fixing device 100.

(Sheet Detecting Means)

The printer 1 includes, in (one) a feeding path of the sheet P, a plurality of sheet sensors (sheet detecting portions, detectors) for detecting the presence (existence) of the sheet P. An entrance sensor S1 described later is one of the plurality of sheet sensors. Further, an exit sensor S2 described later is also one of the plurality of sheet sensors.

The entrance guide 46 is provided with a sensor supporting table 47 including a first sheet detecting portion (detector, sheet sensor, hereinafter referred to as the "entrance sensor") S1. A detecting position where the sheet P is detected by the entrance sensor S1 is on a surface upstream of the nip N with respect to the feeding direction Z.

In the case where in the printer 1, the plurality of sheet sensors are provided upstream of the nip N, of the sensors provided upstream of the nip N, the entrance sensor S1 is disposed at a detecting position (first detecting position) closest to the entrance of the nip N. As the entrance sensor S1, a method of directly detecting the sheet P by a reflection photo-sensor or the like method is usable, but in this embodiment, a constitution operating in contact with the sheet P is used.

The entrance sensor S1 in this embodiment is constituted by a sensor lever 49 mounted rotatably about a rotation shaft 48 and by a photo-interrupter (sensor portion) 42. The sensor lever 49 includes a contact portion 49*b* projected upward from an upper surface of the entrance guide 46 by being rotated and urged in an erecting direction by a spring (urging portion) 43 and includes a shutter portion 49*a* for causing the photo-interrupter 42 to black light. Incidentally, the entrance guide 46 is provided with an opening (not shown) through which the contact portion 49*b* projects upward from the upper surface of the entrance guide 46.

In a free state, the sensor lever 49 is in an erection rotation attitude in which the contact portion 49*b* is projected upward from the upper surface of the entrance guide 46 by an urging force of the spring 43 as shown in FIG. 3. When the sensor lever 49 is in this erection rotation attitude, the shutter portion 49*a* moves to a position where the photo-interrupter 42 permits light transmission (i.e., opens). The controller 24 discriminates by a light-transmission signal of the photo-interrupter 42 that the sheet P is not present at the position (detecting position) of the entrance sensor S1.

Further, the sensor lever 49 is in a falling rotation attitude (FIG. 4) in which the contact portion 49*b* is easily pushed down about the rotation shaft 48 against a spring force of the spring 43 by contact of the sheet P with the contact portion 49*b*. When the sensor lever 49 is in the falling rotation attitude, the shutter portion 49*a* moves to a position where the photo-interrupter 42 blocks light. The controller 24 discriminates by a light-blocking signal of the photo-interrupter 42 that the sheet P is present at the position of the entrance sensor S1.

When the sheet P passes through the position of the entrance sensor S1 and a trailing end thereof is spaced from the contact portion 49*b* of the sensor lever 49, the attitude of the sensor lever 49 is restored to the erection rotation attitude. With this restoration, the shutter portion 49*a* moves from the position where the photo-interrupter 42 blocks the light to the position where the photo-interrupter 42 permits the light transmission, so that an output signal of the photo-interrupter 42 is changed from the light-blocking signal to the light-transmission signal.

That is, on the basis of the light-transmission signal and the light-blocking signal of the photo-interrupter 42 of the entrance sensor S1, the controller 24 detects the presence or absence of the sheet P at a portion upstream of the nip N in the fixing device 100. Incidentally, in this embodiment, a constitution in which the presence of the sheet P at the position of the entrance sensor S1 is detected by that the output signal of the photo-interrupter 42 is the light-blocking signal was employed. The direction is not limited thereto, but may also employ a constitution in which the presence of the sheet P at the position of the entrance sensor S1 is detected by that the output signal of the photo-interrupter 42 is the light-transmission signal.

Further, the exit guide 50 is provided with a second sheet detecting portion (sheet sensor, hereinafter referred to as the "exit sensor") S2 for detecting the presence or absence of the sheet P at a portion downstream of the nip N in the fixing device 100. A detecting position where the sheet P is detected by the exit sensor S2 is on a surface downstream of the nip N with respect to the feeding direction Z. In the case where in the printer 1, the plurality of sheet sensors are provided downstream of the nip N, the exit sensor S2 of the sensors provided downstream of the nip N is disposed at a detecting position (second detecting position) closest to the exit of the nip N.

As the exit sensor S2, a constitution in which an operation of the lever member operating in contact with the sheet P is detected by a photo-interrupter or a method of directly detecting the sheet P by the reflection photo-sensor or the like method can be employed. The photo-sensor capable of detecting the sheet P in a non-contact manner is desirable since the photo-sensor has no influence on feeding of the sheet P and the image.

In this embodiment, as the exit sensor S2, the reflection photo-sensor is used, and the sheet P is irradiated with laser light and detection of the presence or absence of the sheet P is carried out by detecting reflected light of the laser light. That is, by a reflected-light detection signal of the photo-sensor, the controller discriminates that the sheet P is present at the position of the exit sensor S2, and by a reflected-light non-detection signal of the photo-sensor, the controller discriminates that the sheet P is not present at the position of the exit sensor S2.

Figure 4:
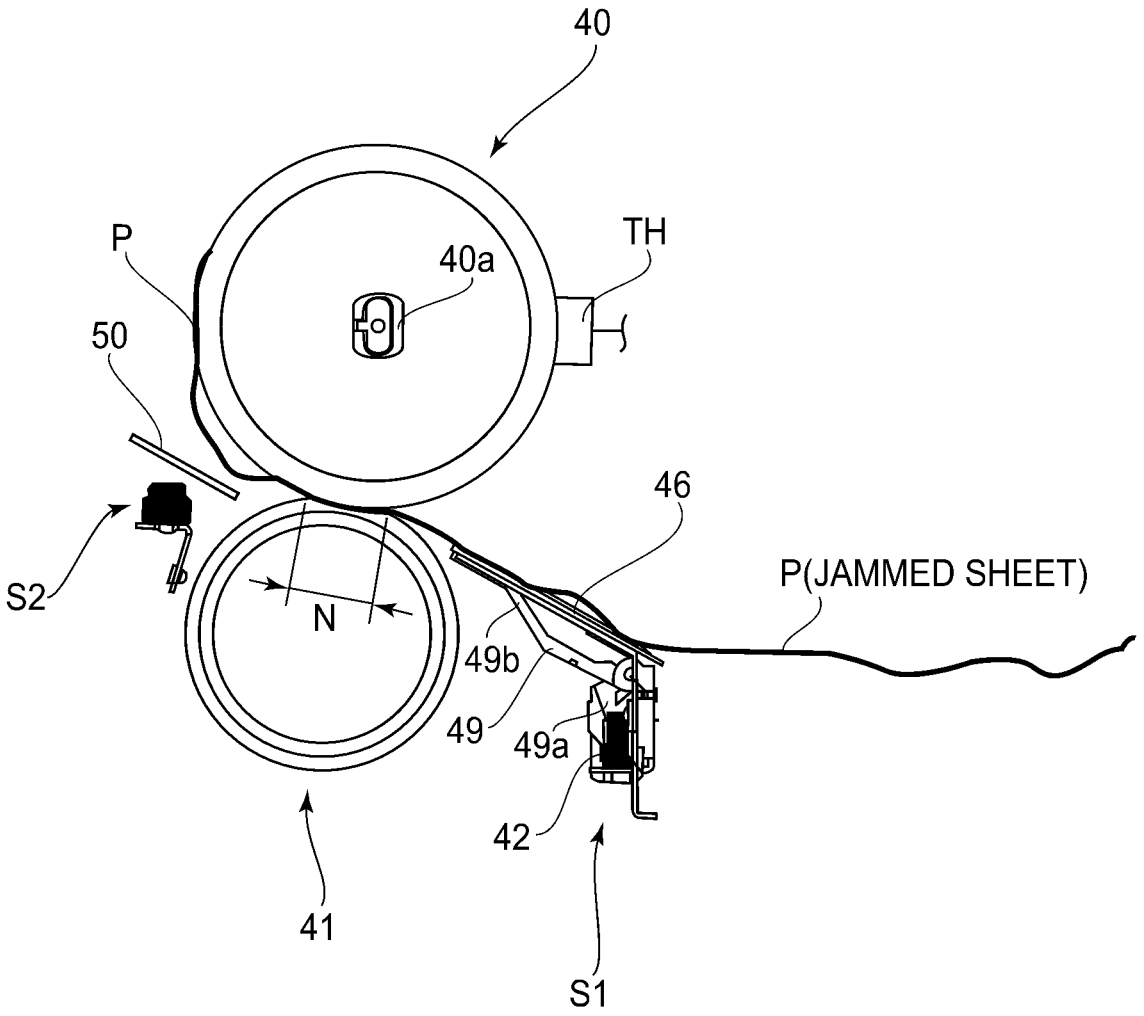
FIG. 4 is a schematic view of an example of a remaining state of a sheet in the fixing device.

In this embodiment, jam detection of the sheet P inside the fixing device 100 is made by a jam detecting logic as described later. FIG. 4 shows a state in which winding jam of the sheet P about the fixing roller 40 generates and fixing operation and control of the fixing device 100 are stopped due to an emergency.

In this winding jam, a leading end portion of the sheet P coming out of the nip N is attracted to the fixing roller 40 and is not separated from the fixing roller 40, and therefore, the sheet detection at the exit sensor S2 is not made. The sensor lever 49 of the entrance sensor S1 is kept in the falling rotation attitude by the sheet P of which feeding is stopped by the emergency stop of the fixing device 100, so that the photo-interrupter 42 outputs the light-blocking signal until the jammed sheet P is removed and thus continuously detects the presence of the sheet P.

(Controller)

Parts (a) and (b) of FIG. 5 are block diagrams of control systems of the printer 1 and the fixing device 100. Part (a) of FIG. 5 is the block diagram of a printer controller. The controller 24 (printer controller 309) is constituted by a processing unit including a CPU, a memory and the like and by a circuit or the like in which data exchanges between itself and an external portion through an input/output portion (I/O port), a communication interface or the like.

The controller 24 not only carries out transfer of various pieces of electric information between the host device 201 and the operating portion 23 but also effects integrated control of the printing operation of the image forming portion 2 in accordance with a predetermined control program or reference table. Further, the controller 24 stores inputted information and determines a printing condition on the basis of the stored information, and then performs a printing operation under a predetermined condition during execution of a print job.

Further, when an operator inputs information of the sheet, to be used, through the operating portion 23 or the like, the controller 24 sets an operating condition of the fixing device 100 depending on a kind or a basis weight of the sheet subjected to the printing. The controller waits for actuation of the fixing device 100 and then provides an instruction of writing start timing of the image forming portion 2. As a result, sheet feeding control is carried out.

Part (b) of FIG. 5 is a control block diagram showing a control object of a controller, of respective controllers shown in the control block diagram of part (a) of FIG. 5, relating to the control of the fixing device 100. A sensor detecting portion 205 includes an entrance sensor detecting portion 304 and an exit sensor detecting portion 305. The entrance sensor detecting portion 304 notifies the printer controller 309 (controller 24) of detection information detected by the entrance sensor S1, and the exit sensor detecting portion 305 notifies the printer controller 309 of detection information detected by the exit sensor S2.

A fixing (portion) controller 206 includes a fixing feeding controller (rotation controller) 302 and a temperature adjusting controller 303. The fixing feeding controller 302 performs rotation and a stop of the rotation of the fixing motor 45 on the basis of a rotation instruction or a (rotation) stop instruction of the fixing roller 40 provided from the controller 24 or a fixing controller 300. The temperature adjusting controller 303 performs electric power supply to the halogen heater 40*a* and a stop of the electric power supply in order to carry out temperature control of the fixing roller 40 instructed from the controller 24.

The controller (jam detecting portion) 24 detects occurrence of a jam on the basis of an output of the sensor detecting portion 205. The controller 24 includes a system timer 301 for counting a time from turning-on of a main switch of the printer 1. The controller 24 makes reference to the detection information notified from the entrance sensor detecting portion 304 and the exit sensor detecting portion 305 of the sensor detecting portion 205 and a timer value of the system timer 301, and makes discrimination of jam occurrence in the fixing device 100. In the case where the controller 24 discriminated that the jam generated, the controller notifies the feeding controller 300 of the jam occurrence in the fixing device 100.

The feeding controller 300 provides the stop instruction of the fixing motor 45 to the fixing feeding controller 302 and brakes the fixing motor 45, and thus suddenly stops the fixing motor 45. That is, when the feeding controller 300 stops the fixing motor 45 during a normal operation, the feeding controller 300 stops the fixing motor 45 by inertia through cut-off of the electric power and carries out control such that the feeding controller 300 suddenly stops the fixing motor 45 by braking the fixing motor 45 by a motor control IC (braking means, not shown) only when the controller 24 discriminated that the sheet jammed in the fixing device 100.

By the sudden stop of the fixing motor 45 by the braking, a rotation amount by inertia can be reduced to about 1/10 compared with the case where the fixing motor 45 is stopped by the cut-off of the electric power during the normal operation. However, in actuality, even in the case where the fixing motor 45 is suddenly stopped, inertia slightly generates (for example, about 50 mm in terms of a sheet feeding distance). Further, the feeding controller 300 provides rotation instruction of the fixing motor 45 to the fixing feeding controller 302, and thus controls a rotational speed of the fixing motor 45 so that the fixing roller 40 rotates at a predetermined rotational speed. Further, the feeding controller 300 also controls feeding of a feeding portion other than that of the fixing device 100.

(Jam Detecting Logic in Fixing Device)

Next, the printing operation in the printer 1 and the control operation in the case where feeding failure (jam) of the sheet P generated in the fixing device 100 will be described using a flowchart shown in FIG. 6.

Whether or not the sheet P jammed in the fixing device 100 is detected by the exit sensor S2 provided downstream of the nip N. In synchronism with the image formation timing, the controller 24 makes reference to a timer value of the system timer 301 from a start of the feeding of the sheet P by the registration roller pair 14. Then, in the case where the exit sensor S2 cannot detect the feeding of the sheet P even when a predetermined time elapsed (but the entrance sensor S1 detected the sheet P), the controller 24 has discriminated that the sheet P jammed in the fixing device 100.

When the fixing motor 45 is started (step S101), the controller 24 waits for a start of feeding of the sheet P, fed from either one of the sheet feeding portions 9 to 12, by the registration roller pair 14 in synchronization with the image formation timing (S102). When the feeding of the sheet P by the registration roller pair 14, the controller 24 waits for arrival of the sheet P at the exit sensor S2 (S103). Then, when a predetermined time elapsed from the start of the registration roller pair 14 (S106), the controller 24 discriminates that there is a possibility that the sheet P jammed in the fixing device 100.

The predetermined time is a time in which the sheet P of which feeding is started by the registration roller pair should reach the exit sensor S2 by being successfully fed. That is, when the exit sensor S2 cannot detect the sheet P even after the lapse of the predetermined time (but the entrance sensor S1 detected the sheet P), the sheet P is discriminated that there is a possibility that the sheet P jammed in the fixing device 100. Then, the controller 24 suddenly stops the printing operation and control of the printer 1 including the fixing operation and control of the fixing device 100.

Incidentally, in this embodiment, the start of the drive of the registration roller pair 14 was taken as a starting point of the printer time, but the starting point is not limited thereto. For example, timing when the sheet sensor disposed upstream of the nip N with respect to the sheet feeding direction Z detected the presence of the sheet P may also be taken as the starting point.

As regards the fixing motor 45, control such that the motor control IC as the braking means brakes the fixing motor 45 and suddenly stops the fixing motor 45 is carried out (S107). As regards the image forming portion 2, a photosensitive drum motor (not shown) is stopped.

Further, as described later, a message prompting the operator to perform jam clearance is displayed at a display portion (notifying portion) of the operating portion 23.

When the sheet P is normally fed and can be detected in the predetermined time by the exit sensor S2, the sheet P is discharged from the fixing device 100 (S104). Further, in the case where a subsequent (next) sheet exists, the sequence returns to the step S102 again. In the case where the subsequent sheet does not exist, the fixing motor 45 is stopped and the printing operation is ended (S108). That is, during an end of the normal printing operation, when the fixing motor 45 is stopped, the fixing motor 45 is stopped by inertia through cut-off of the electric power.

As described above, by adding a braking function to the fixing motor 45, only when the controller 24 discriminated that the sheet P jammed in the fixing device 100, the fixing motor 45 is suddenly stopped by the braking. As a result, an amount of winding of the jammed sheet P into the fixing device 100 by inertia of the fixing motor 45 can be suppressed to a minimum, so that a post-process when the sheet P jammed be comes easy.

(Sensor Arrangement, Sheet Length and Jam Stop)

Figure 1:
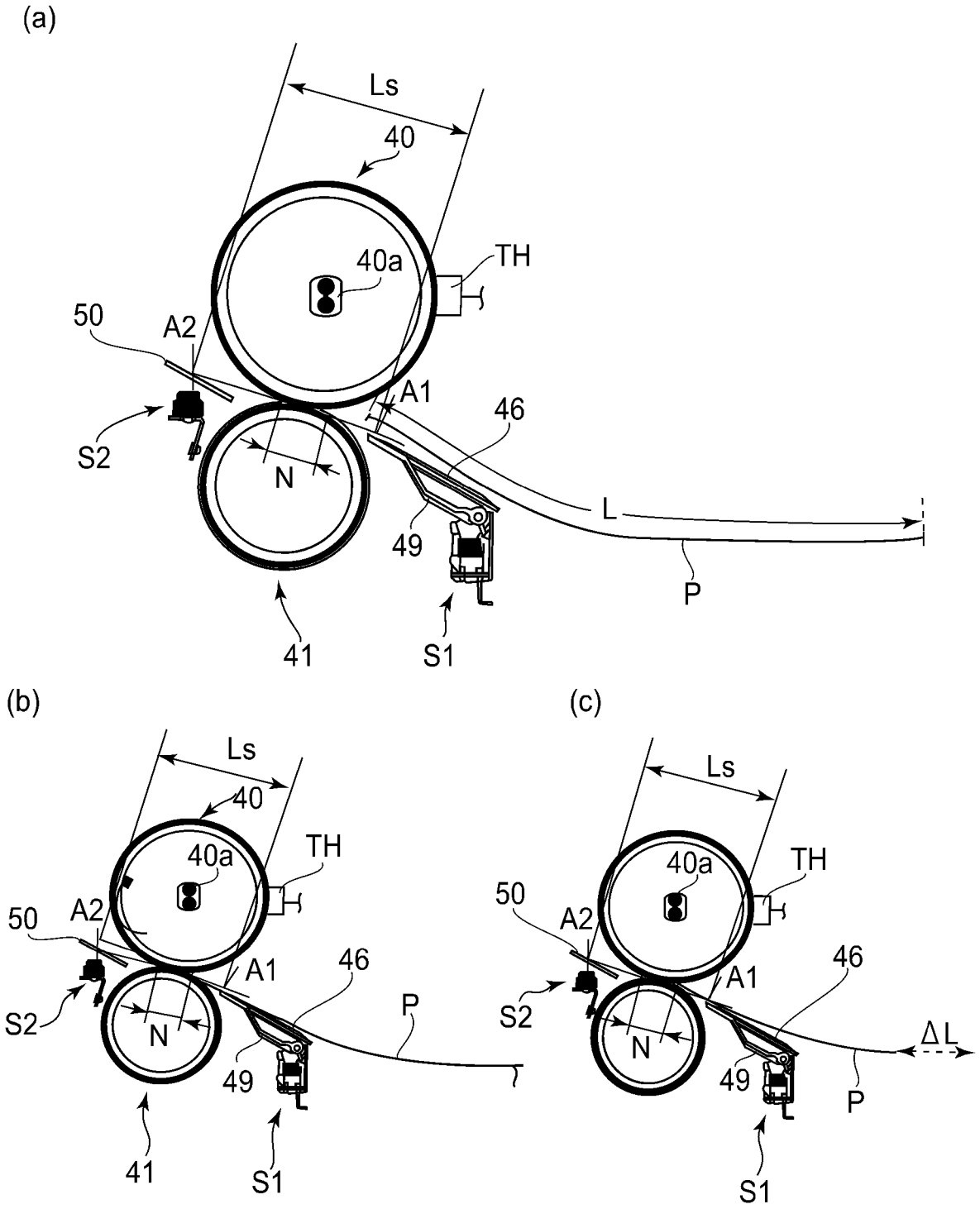

Next, with reference to FIG. 1, during the sudden stop of the fixing device 100 due to the detection of the jam generated in the fixing device 100, a relationship among a distance until the sheet P stops, a length of the sheet P and detecting positions of the entrance sensor S1 and the exit sensor S2 will be described. As described above, in the case where the fixing device 100 suddenly stops due to the jam generated in the fixing device 100, jam clearance (removal of the jammed sheet P) by the operator is performed. In the printer 1, in order to check completion of the jam clearance, whether or not the remaining sheet P exists in the fixing device 100 is detected.

A length of the sheet P measured in the feeding direction Z is L. A distance (a length along a sheet feeding path) between detecting portions from a sheet detecting position (first sheet detecting position) A1 by the entrance sensor S1 to a sheet detecting position (second sheet detecting position) A2 on the sheet feeding path via the nip N is Ls. In this case, the first sheet detecting position A1 is at least a position where the distance Ls between the detecting portions is smaller than a length Lmin of the sheet P of which length measured in the feeding direction is shortest among sizes of the sheets P permitted to pass through the nip N in the printer 1.

Incidentally, in the case where winding jam generated, in order to preferably detect that the sheet P remains in the nip N, the first sheet detecting position A1 may preferably be close to the nip N to the extent possible. In this embodiment, in the case where control of a feeding speed described later is carried out, when the sheet P with a minimum length Lmin caused the winding jam, the first sheet detecting position A1 is a position where the contact portion 49*b* of the sensor lever 49 can be pressed down by the sheet P stopped due to the jam.

A sheet feeding speed at the nip N by a rotating operation of the fixing roller 40 and the pressing roller 41 during the printing operation is Vm (first feeding speed). A sheet feeding amount until at the feeding speed Vm, the fixing motor 45 is suddenly stopped by braking the fixing motor 45 is Lm. A waiting time (delay margin time) from a nominal time of sheet detection of the exit sensor S2 on the basis of the system timer 301 until the controller 24 makes jam discrimination is Tm. Further, a delay time required from the jam discrimination to a start of the sudden stop of the fixing motor 45 by the braking is Td.

A maximum distance (movement amount during the stop, hereinafter referred to as a post-jam movement amount) in which a trailing end of the sheet P advances from the jam discrimination by the controller 24 to the stop of the sheet P is ΔL. ΔL is a movement amount of the sheet P fed through the nip N in a period from the jam discrimination until the rotating operation of a rotatable member pair consisting of the fixing roller 40 and the pressing roller 41 is stopped through a start of deceleration when the drive of the rotatable member pair during feeding of the sheet P through the nip N is stopped due to the jam discrimination.

A time when the post-jam movement amount ΔL becomes maximum is a time when the jam discrimination is made by the controller 24 immediately before the sheet P reaches the second sheet detecting position A2. This is because there is a liability that the sheet P winds about the fixing roller 40. In this case, the post-jam movement amount ΔL is:

$$\Delta L = Lm + Vw \times (Tm + Td).$$

Here, the above-described waiting time (delay margin time) Tm will be specifically described. When a leading end of the sheet does not reach the second sheet detecting position A2 of the exit sensor S2 in a period from a reference time T1 (for example, a sheet feeding start time of the registration roller pair) to a lapse of 10.0-10.5 sec, the controller 24 discriminates that delay jam generates. That is, the waiting time Tm in this case is a time from "time A=T1+10.0" to "time B=T1+10.5". In the case where the sheet P is not detected by the exit sensor S2 even at the time B, the controller 24 discriminates that a delay of sheet feeding generated due to feeding failure of the sheet and thus makes the jam discrimination.

Here, such a range from the lapse of 10.0 sec to the lapse of 10.5 sec is provided on the assumption that there is an error in feeding speed which can generate when the same sheet P is fed. The time A is a shortest time when the sheet P reaches the nip N in the case where the sheet p is fed without causing the jam.

When a length obtained by subtracting the post-jam movement amount ΔL from the length of the sheet P measured in the feeding direction Z is not less than the detection distance Ls before and after the nip N (i.e., $L-\Delta L \geq Ls$), even when the sheet P caused the jam winds about the fixing roller 40, the trailing end of the sheet P can be detected by the sensor S1. That is, in the case where the feeding direction length of the sheet P, sensor arrangement and the rotational speed of the fixing roller 40 satisfy such a relationship, even when the sheet P winds about the fixing roller 40 and cannot be detected by the exit sensor S2, the sheet P can be detected by the entrance sensor S1.

In the fixing device 100 in which such a relationship is established, the presence of the sheet P stopped due to the jam generated in the fixing device 100 can be detected by either of the entrance sensor S1 and the exit sensor S2. Further, the remaining of the sheet P in the fixing device 1 can be suitably detected.

A jam clearing (eliminating) operation when the remaining of the sheet P in the fixing device 100 is detected will be described using a flowchart shown in FIG. 7. In the case where the sheet P is removed from a jam state, a state in which the entrance sensor S1 does not detect the sheet P is formed, and therefore, the controller 24 discriminates that the jammed sheet P was removed.

On the other hand, in the case where the operator overlooks the sheet P stopped due to the jam generated in the fixing device 100 and thus the sheet P is not removed from the jam state, the sensor lever 49 is kept pushed by the sheet P. As a result, the shutter portion 49*a* continuously causes the photo-interrupter 42 to block the light, and therefore, the entrance sensor S1 is in a state in which the entrance sensor S1 continuously detects the sheet P.

That is, the entrance sensor S1 functions as the detector for detecting the sheet P remaining in the nip at the detecting position on the side upstream of the nip N with respect to the sheet feeding direction Z. When the presence of the jammed sheet P is detected by the entrance sensor S1 (YES of S7-2), in response to a detection signal from the entrance sensor S1, the controller 24 displays a clearance instruction of the jammed sheet remaining in the fixing device 100 at the display portion 32 (FIG. 8) of the operating portion 23 (S7-3). Incidentally, thereafter, in accordance with this remaining sheet clearance display, when the operator completes the remaining sheet clearance, the controller 24 receives the print signal again, so that the printer 1 is capable of performing the printing operation.

On the other hand, even when the remaining sheet clearance is performed as described above and the entrance sensor S1 is in a sheet non-detection state (NO of S7-2), in the case where the jam state in the printer 1 is not eliminated (YES of S7-4), the controller 24 detects a jam generating position other than the fixing device 100. Then, the controller 24 displays jam clearance at the detected jam generating position on the display portion 32 of the operating portion 23 (S7-6). Incidentally, thereafter, when the operator completes the jam clearance in accordance with the jam clearance display, the controller 24 receives the print signal again, so that the printer 1 is capable of performing the printing operation (S7-5).

When the fixing device 100 as described above is used, even in the case where the operator neglects the removal of the jammed sheet P, the sheet P remaining in the fixing device 100 is detected by the entrance sensor S1. Then, the remaining mode does not return to a normal printing mode, and error display is kept made.

(Operating Portion)

FIG. 8 is a schematic view of the operating portion 23. The operating portion 23 includes the display portion (notifying portion) 32 and the operation inputting portion 33. The operation inputting portion 33 is provided with a main switch 31, a numeric keypad 29, a start key 30 for starting the printing, a clear key 28 and the like.

The display portion 32 is a liquid crystal screen of a touch panel type. At the display portion 32, it is possible to display various pieces of information (i.e., display messages), for example, display (notification) of a state of the printer, error information, jam information, another information, and the like. Further, at the display portion 32, display of various operation buttons (keys) is also made. The operator can provide an instruction of a printing condition (various setting) through the displayed buttons.

The operator not only provides the print start instruction but also can perform image quality setting of the image and information input (sheet registration of the sheet feeding portions) of the sheets P set in the sheet feeding portions (accommodating portions) 9 to 12 by using the display portion 32 and the operation inputting portion 33. That is, the operating portion 23 functions as an inputting portion and is capable of selecting or inputting the length of the sheet, to be used, measured in the sheet feeding direction. As a result, the controller (acquiring portion) 24 acquires information of the feeding direction length of the sheets set in the sheet feeding portions 9 to 12. The controller 24 determines the printing condition on the basis of the information inputted from the display portion 32 or the operation inputting portion 33 and then performs the printing operation under a predetermined condition during the printing.

FIGS. 9A to 9C show examples of sheet size inputting screens at the display portion 32 during sheet registration of the sheet feeding portions. FIG. 9A is a setting screen of the sheets. Sheet sizes are displayed on central buttons 321 and 324 correspondingly to the first and second sheet feeding cassettes 9 and 10, the sheet feeding device 11 and the tray 12, respectively. In the case where the sheets used have regular sizes (sizes defined by ISO, JIS, ANSI A-E, and the like, A4 size, B5 size, Letter (LTR) size, and the like), sheet sizes detected through automatic size detection described later are displayed.

In the case where there is an error in irregular sizes other than the regular sizes or in detection result, after selecting the button associated with the sheet feeding position, by selecting a "user-defined (setting) size" button 326, the screen goes to a sheet size inputting screen.

FIG. 9B is a screen for inputting the regular and irregular sheet sizes. On windows 328 and 329 provided at a lower left portion of the screen, lengths corresponding to the sheet size is settable from a numerical keypad 330 on the screen or from the numerical keypad 29 of the operation inputting portion 33.

FIG. 9C is a screen for selecting a sheet (paper) kind such as plain paper, thick paper, thin paper, coated paper, OHP or the like. To the screen of FIG. 9C, by selecting a setting button 325 after selecting one of the buttons 321 to 324 associated with the sheet feeding position shown in FIG. 9A, the sheet setting screen is capable of going. The setting of the sheet kind and sheet thickness is not automatically detected, and therefore, there is a need that the operator manually set the sheet kind (sheet thickness).

(Sheet Size Detection at Cassette)

As regards a sheet size detecting method at the sheet feeding cassettes 9 and 10, the large-capacity sheet feeding device 11 (accommodating portion for accommodating sheets to be supplied to the image forming portion 2), description will be made using a constitution of the first sheet feeding cassette 9 as a representative.

At a bottom of this sheet feeding cassette 9, a bottom plate (not shown) for raising the sheets P up to an arbitrary position in a state in which the sheets P are mounted thereon is provided. A mounted bundle of sheets 151 is regulated by a pair of slidable (movable) side fences (movable members) 54 with respect to a widthwise direction perpendicular to the sheet feeding direction and is regulated by a pair of slidable (movable) end fences (movable members) 52 with respect to the sheet feeding direction. The side fences 54 and the end fences 52 slid by the operator when the operator mounts the sheets P on the sheet feeding cassette 9.

By the side fences 54, a side detecting portion for detecting a size of the sheets P measured in a lateral direction (widthwise direction) is constituted. That is, the side fences 54 are an acquiring portion for acquiring information corresponding to the size of the sheets, accommodated in the accommodating portion, measured in the widthwise direction perpendicular to the sheet feeding direction. By the end fences 52, an end detecting portion for detecting a length of the sheets measured in a lengthwise direction is constituted. That is, the end fences 52 are an acquiring portion for acquiring information corresponding to the size of the sheets measured in the sheet feeding direction. Positions of the respective fences 52 and 54 are detected by sensors (position detecting portions, not shown), and pieces of detection information are inputted to the controller 24.

The controller 24 is capable of automatically detect the respective lengths, measured in the widthwise direction and the lengthwise direction, of the sheets P set in the first sheet feeding cassette 9, on the basis of the inputted information. This is true for the second sheet feeding cassette 10 and the large-capacity sheet feeding device 11.

As regards the manual feeding tray 12, when the sheets P are set in the tray 12, at the display portion 32 of the operating portion 23, an irregular size inputting screen shown in FIG. 9B is automatically displayed. This saves time and labor of the operator when the operator manually inputs or selects a sheet size (particularly, an irregular sheet size) in the case where the sheet size cannot be detected by the sheet size detecting portion of the printer.

(Handling of Sheet Having Length in Which Remaining of Sheet in Fixing Device Cannot be Detected at Sheet Feeding Speed Vw)

Next, an operation of the printer 1 in the case where a length obtained by subtracting the post-jam movement amount ΔL described above from a length L, measured in the feeding direction Z, of the sheet P used under setting of a sheet feeding fixing device Vw is shorter than a nip-including detection distance Ls (i.e., L=ΔL<Ls) will be described. In the fixing device 100 of this embodiment, the rotational speed of the fixing roller 40 is determined on the basis of the length of the sheet measured in the feeding direction. Accordingly, when sheets having the same size and basis weight measured in the widthwise direction perpendicular to the feeding direction are compared with each other, the rotational speed of the fixing roller 4 varies depending on the sheet length measured in the feeding direction.

Specifically, a first sheet is a first width in length measured in the feeding direction, a first basis weight in basis weight, and L1 in length L measured in the feeding direction. In the case where the sheet to be fed to the nip N is the first sheet, the controller 24 causes the fixing roller 40 to rotate at a first speed. Here, the first speed refers to a speed at which the entrance sensor S1 can detect the presence of the first sheet when rotation of the fixing roller 40 is stopped in response to detection of the occurrence of the jam by the jam detecting portion during passing of the first sheet through the nip N.

A second sheet is the first width in length measured in the feeding direction similarly as the first sheet, the first basis weight in basis weight similarly as the first sheet, and L2, in length L measured in the feeding direction, shorter than L1 of the first sheet. Here, the length L2 of the second sheet measured in the feeding direction refers to a length in which a trailing end of the second sheet cannot be detected in the case where the second sheet stops at the nip N if the second sheet is fed into the nip N at a feeding speed (first speed) equal to that during feeding of the first sheet.

The controller 24 causes the fixing roller 40 to rotate at a second speed slower than the first speed. That is, the controller 24 causes the fixing roller 40 to rotate at the second speed at which the entrance sensor S1 can detect the presence of a predetermined sheet when rotation of the fixing roller 40 is stopped in response to detection of the occurrence of the jam by the jam detecting portion during passing of the predetermined sheet through the nip N.

For example, in the case where a range of the feeding direction length of the sheet P usable in the image forming apparatus 1 is Lmin (minimum length) or more and Lmax (maximum length) or less, Lmin≤182 mm≤Lmax holds, and it is difficult to detect the sheet P by the entrance sensor S1 in the length L≤182 mm, the rotational speed is the second speed when the feeding direction length L of the sheet P satisfies: Lmin≤L≤182 mm, and is the first speed when the feeding direction length L of the sheet P satisfies: 182 mm<L≤Lmax.

Incidentally, the rotational speed of the fixing roller 40 refers to a rotational speed in a state in which the sheet P is nipped at the nip N and a trailing end of the sheet P has come out of a feeding nip (for example, a nip between feeding roller pair, a transfer nip or the like) provided on a side upstream of the nip N. In the following, a specific control thereof will be specifically described using FIG. 10 as an example.

FIG. 10 is a flowchart of a sheet setting operation and a printing operation. In summary, on the basis of the feeding direction length L of the sheet used, the distance Ls between the detecting portions, and the post-jam movement amount ΔL, the controller (discriminating portion) 24 discriminates whether these parameters satisfy "L≥Ls+ΔL" or "L<Ls+ΔL". Then, on the basis of a discrimination result, the controller 24 controls the printing operation of the printer 1.

When as regards the sheet used, the sheet size is inputted from the operating portion 23 or is detected by the above-described automatic detection at the sheet feeding cassettes 9 and 10 or at the large-capacity sheet feeding device 11 (S10-1), the controller 24 discriminates the feeding direction length L of the sheet (S10-2).

L≥Ls+ΔL refers to the case where when the printing operation and control of the printer 1 including the fixing operation and control of the fixing device are stopped due to an emergency such that the jam generated in the fixing device 100, the feeding direction length L is a sheet length in which the trailing end of the sheet P stopped in the fixing device is capable of being detected by the entrance sensor S1. In this case, sheet signal is received by the controller 24, and the sequence of the controller 24 goes to the printing operation (S10-3).

Here, the printing operation refers to a printing operation (normal printing operation) under setting such that a sheet feeding speed of an entirety of the printer 1 including also rotating operations of the fixing roller 40 and the pressing roller 41 in the fixing device is a first feeding speed Vw. That is, the controller 24 controls the number of turns (rotations) of the fixing roller 40 so that the sheet feeding speed is Vw. A surface movement speed of the fixing roller 40 at this time is a first speed such that the sheet feeding speed is Vw.

On the other hand, $L<Ls+\Delta L$ refers to the case where the feeding direction length L is a sheet length in which the trailing end of the sheet P stopped in the fixing device 100 due to the occurrence of the jam cannot be detected by the entrance sensor S1. In this case, the controller 24 changes the setting of the sheet feeding speed (fixing rotational speed) in the fixing device 100 from the first feeding speed Vw to a decelerated speed (second feeding speed) Vw' lowered in a predetermined manner (S10-4). That is, the controller 24 controls the number of turns (rotations) of the fixing roller 40 so that the sheet feeding speed is Vw'. A surface movement speed of the fixing roller 40 at this time is a first speed such that the sheet feeding speed is Vw'.

Incidentally, in this embodiment, the setting of the sheet feeding speed from the sheet feeding portions 9 to 12 to the fixing device 100, exactly to the nip N of the fixing device 100 is kept at the first feeding speed Vw.

When the sheet feeding speed in the fixing device 100 is lowered from the speed Vw to the speed Vw', rotational inertia of the fixing motor 45 is decreased. For that reason, not only a rotation amount of the fixing motor 45 until rotation of the fixing motor 45 is stopped when the fixing motor 45 is suddenly stopped by braking is decreased (from Lm to Lm'), but also the post-jam movement amount of the sheet P fed through the nip N in the delay margin time Tm and in the delay time Td is also decreased (from $\Delta L$ to $\Delta L'$) (S10-5).

Then, under a condition such that the setting of the sheet feeding speed in the fixing device 100 is changed from the speed Vw to the decreased speed Vw', in the case where $L>Ls+\Delta L'$ is satisfied in S10-6, the trailing end of the sheet P stopped due to the occurrence of the jam in the fixing device 100 is detectable by the entrance sensor S1. However, the sheet feeding speed in the fixing device 100 is lowered from the speed Vw to the speed Vw', and therefore, the controller 24 causes the display portion (notifying portion) 32 to display (notify) a warning message as shown in FIG. 11 (S10-7). Then, in the case where on the display, execution of a remedial action (operation) is selected by the operator, the sequence goes to the printing operation (S10-3).

The printing operation in this case is the remedial action, and the sheet feeding speed in the fixing device 100 is set at the decelerated speed Vw', and the operation is executed while keeping the setting of the sheet feeding speed, at the speed Vw, from the sheet feeding portions 9-12 to the fixing device 100 (i.e., to the nip N of the fixing device 100).

Further, when $L<Ls+\Delta L'$ is satisfied in S10-6, the controller 24 causes the display portion 32 to display a warning message 340 as shown in FIG. 12 (S10-8) and thus an "OK" button 327 on a sheet selecting screen is put in a gray-out state and is made unselectable. As a result, the controller 24 prompts the operator to change the sheet (S10-9). Discrimination regarding a changed sheet size is similarly carried out in the step (S10-2).

According to the printer 1 of this embodiment, on the basis of the feeding direction length of the sheet determined by the input of the operator or the automatic detection in the printer 1, the printing operation is changed, so that the sheet remaining in the fixing device 100 in the case where the jam generated in the fixing device 100 can be suitably suppressed.

1) In this embodiment (Embodiment 1), as the setting of the sheet feeding speed, two values Vw and Vw' were described as an example, but a constitution in which a plurality of sheet feeding speeds (fixing rotational speeds) at three levels or more is settable may also be employed.

As regards the sheet size, in the case where the sheet size inputted from the operating portion 23 or the sheet size L detected through the above-described automatic detection at the sheet feeding cassettes 9 and 10 or at the large-capacity sheet feeding device 11 satisfies $L\geq Ls+\Delta L$, the printing operation is performed under setting such that the sheet feeding speed is the first feeding speed Vw.

On the other hand, the case where $L\geq Ls+\Delta L$ is not satisfied (i.e., $L<Ls+\Delta L$) refers to the case where the trailing end of the sheet P stopped in the fixing device 100 due to the occurrence of the jam cannot be detected by the entrance sensor S1 at the sheet feeding speed Vw. In this case, when $L\geq Ls+\Delta L'$ is satisfied under a condition such that the setting of the sheet feeding speed (fixing rotational speed) is changed from the first feeding speed Vw to the decelerated speed (second feeding speed) Vw' lowered in speed from the speed Vw in a predetermined manner, the detecting operation is performed at the speed Vw'.

Under the condition such that the speed is changed to Vw', in the case where $L\geq Ls+\Delta L'$ is not satisfied (i.e., $L<Ls+\Delta L'$), whether or not detection by the entrance sensor S1 can be made at a deceleration speed (third feeding speed) Vw" lowered from the second feeding speed Vw' in a predetermined manner is discriminated.

In the case where the post-jam movement amount of the sheet P at the third feeding speed Vw" is $\Delta L''$, when $L\geq Ls+\Delta L''$ is satisfied, the printing operation is executed at the third feeding speed Vw". When $L\geq Ls+\Delta L''$ is not satisfied (i.e., $L<Ls+\Delta L''$), as shown in S10-8 and S10-9 of FIG. 10, the controller 24 prompts the operator to change the sheet.

That is, when the feeding direction length is such a length as the satisfy $L\geq Ls+\Delta L$, the sheet feeding speed is set at the first feeding speed Vw. When the feeding direction length is such a length as the satisfy $L<Ls+\Delta L$ and $L\geq Ls+\Delta L'$, the sheet feeding speed is set at the second feeding speed Vw'. When the feeding direction length is such a length as to satisfy $L<Ls+\Delta L'$ and $L\geq Ls+\Delta L''$, the sheet feeding speed is set at the third feeding speed Vw".

2) In this embodiment, as regards the discrimination in S10-2 of FIG. 10, a constitution in which on the basis of the inputted or detected sheet size, the controller 24 carried out the discrimination by calculating a relationship between L and $Ls+\Delta L$ in each case was employed, but the present invention is not limited thereto. For example, signal of the sheet feeding speeds (Vw and Vw') satisfying $L>Ls+\Delta L$ (or $L\geq Ls+\Delta L'$) is stored in advance in a memory of the controller 24 every sheet size which is inputtable or detectable. A constitution in which the controller 24 controls the sheet feeding speed on the basis of information of the memory may also be employed. The relationship between the sheet length measured in the feeding direction and the sheet feeding speed is as described above. Incidentally, the above is true for the case where the sheet feeding speed is set at three levels (Vw, Vw', Vw") or more.

3) In this embodiment, the entrance sensor S1 and the exit sensor S2 were described using the method in which the photo-interrupter and the sheet detecting arm were used or using the constitution in which the detecting means using the laser light reflection was used, but the present invention is not limited thereto. When a method of detecting the presence or absence of the sheet before and after the nip N is used, the type and the arrangement position of the sensors are not limited to those described above.

4) In this embodiment, as the type of the rotatable member pair for fixing the toner image t on the sheet P, description was made using the type in which the nip is formed by the roller-shaped members, but a constitution in which the toner is melted and fixed on the sheet P may be used. For example, such a type is also suitably applicable to also a constitution using belt-shaped members in place of the roller-shaped members or a constitution using KH or a laser as a heating source.

5) In the flowchart described using FIG. 10, in the step S10-2, when $L<Ls+\Delta L$ is satisfied, the setting of the sheet feeding speed (fixing rotational speed) in the fixing device 100 is automatically decreased from the setting of the speed Vw to the setting of the speed Vw'. However, the present invention is not limited to this control constitution. For example, a flowchart of a sheet setting operation and a printing operation as shown in FIG. 13 may also be employed.

That is, in the flowchart of FIG. 13, in a step S13-2, in the case where $L<Ls+\Delta L$ is satisfied, a screen for prompting the operator to select execution or non-execution of the remedial action is displayed on the display portion 32, so that an instruction of operator is sought (S13-4). At this time, in a method in which the sheet feeding speed (fixing rotational speed) in the fixing device 100 is decreased from the speed Vw to the speed Vw' as the remedial action, the feeding speed of the sheet P is lowered, so that productivity lowers in some cases.

For that reason, as shown in FIG. 11, by displaying the warning message of "SHEET LENGTH IS IMPROPER AND THEREFORE PRODUCTIVITY LOWERS IN SOME CASES", it is possible to suppress a situation that the productivity lowers in an unclear situation. Then, the controller 24 determines, in accordance with an instruction of the operator, whether or not the remedial action should be carried out (S13-5).

In S13-4, in the case where the relationship of $L\geq Ls+\Delta L$ is satisfied by, without decreasing the sheet feeding speed, changing the direction of the sheets P stacked on the sheet feeding cassettes 9 and 10, the large-capacity sheet feeding device 11 or the manual feeding tray 12, the following display may also be performed. That is, display for prompting the operator to change an orientation of the sheets P, set in a direction in which the length measured in the feeding direction Z is a length of a short side of the sheets P, to a direction in which the length measured in the feeding direction Z is a length of a long side of the sheets P may also be performed.

That is, in the case where acquired sheet size information indicates not only that the sheet length measured in the feeding direction is a first length which is not more than a length of a short side of a predetermined sheet but also that the sheet length measured in the widthwise direction is a second length which is not more than a length of a long side of the predetermined sheet, the controller 24 notifies the operator of prompting of the change in orientation of the sheets accommodated in the accommodating portion.

Incidentally, this constitution is also applicable to the case where the condition is discriminated as "NO" in S13-8 (or S10-6 of FIG. 10).

Other operations are pursuant to the flowchart described with reference to FIG. 10, and therefore, further description of FIG. 13 will be omitted.

6) Changing means of sheet feeding speed

As a charging method of the sheet feeding speed (fixing rotational speed) Vw' in the fixing device 100, there are some methods.

A first method is such that only the sheet feeding speed Vw in the fixing device 100 is changed without changing the sheet feeding speed at portions other than the fixing device 100. That is, the change of the sheet feeding speed (fixing rotational speed) Vw in the fixing device 100 is carried out in a range in which the change of the speed Vw can be absorbed by a gap (interval) time $\Delta T$ between a prior sheet and its subsequent sheet which are successively fed from one of the sheet feeding portions 9-12. That is, the change of the sheet feeding speed Vw in the fixing device 100 is carried out in a range of $L/(Vw-Vw')>\Delta T$.

This is because when $L/Vw-Vw')\leq\Delta T$ is satisfied, the prior sheet and the subsequent sheet are discharged in a state in which a trailing end of the prior sheet and a leading end of the subsequent sheet overlap with each other, and therefore, the passing of the sheet P cannot be detected by the exit sensor S2.

As a second method, there is a method in which in order to realize $L/(Vw-Vw')>\Delta T$, an interval for feeding the sheets P from the sheet feeding portions 9-12 is increased (i.e., a sheet interval is simply increased). This method is simpler than the first method, as a method in which the sheet feeding B speed Vw in the fixing device 100 can be decreased to a lower speed than that by the first method. However, throughput (ppm: the number of printable sheets per (one) minute) which is the number of sheets P discharged per time from the printer 1 lowers.

Therefore, as a third method, there is a method in which the sheet is once fed at an increased speed before or after the fixing device 100 (i.e., a method in which the sheet interval is increased at the increased speed). In this method, for example, after the trailing end of the sheet passes through the nip N of the fixing device 100, the gap time $\Delta T$ can be increased by increasing the feeding speed of the sheet. As a result, while suppressing a lowering in productivity (throughput), the sheet feeding speed Vw can be decreased to a speed lower than that in the first method.

Part (a) of FIG. 14 is a diagram chart of feeding of the prior sheet and the subsequent sheet in a normal printing operation under setting such that the sheet feeding speed, in an entirety of the printer 1, including the fixing rotational speed of the fixing device 100 is Vw. Part (b) of FIG. 14 is a diagram chart showing a state such that a trailing end of the prior sheet and a leading end of the subsequent sheet overlap with each other when the sheet feeding speed Vw in the fixing device 100 is lowered and thus $L/(Vw-Vw')\leq\Delta T$ is satisfied.

Further, part (a) of FIG. 15 is a diagram chart showing a positional relationship between the trailing end of the prior sheet and the subsequent sheet fed subsequently to the prior sheet in the case where the sheet feeding speed is increased in the rear of the fixing device 100 by increasing a sheet feeding interval. Part (b) of FIG. 15 is a diagram chart showing a position of the leading end of the prior sheet at that time in comparison with the example of part (a) of FIG. 14.

In FIGS. 14 and 15, an abscissa represents a timer value (time), and an ordinate represents a feeding path position of the sheet P in the printer 1. A lower end of a continuous line graph shows a sheet feeding P, and an upper end of the like graph shows a discharge position. A slope of the line graph shows the sheet feeding speed. The sheet once stopped by the registration roller pair is fed and decelerated so as to satisfy $L \geq Ls+\Delta L'$ in the fixing device 100. An interval between the leading end and the trailing end of each of the prior sheet and the subsequent sheet is substantially equal to the sheet feeding direction length. Incidentally, in FIG. 14, a is the leading end of the prior sheet, b is the trailing end of the prior sheet, c is the leading end of the subsequent sheet, and d is the trailing end of the subsequent sheet. In part (a) of FIG. 14, e is the leading end of the prior sheet when the speed is changed relative to that of part (a) of FIG. 14, f is the trailing end of the prior sheet when the speed is changed relative to that of part (a) of FIG. 14, g is the leading end of the subsequent sheet when the speed is changed relative to that of part (a) of FIG. 14, and h is the trailing end of the subsequent sheet when the speed is changed relative to that of part (a) of FIG. 14. In part (b) of FIG. 14, i is the leading end of the prior sheet when the speed is changed relative to that of part (a) of FIG. 14, i is the leading end of the subsequent sheet when the speed is changed relative to that of part (a) of FIG. 14, k is the leading end of the prior sheet shown in part (a) of FIG. 14, and l is the leading end of the subsequent sheet shown in part (a) of FIG. 14.

In part (b) of FIG. 14, the sheet feeding speed Vw lowers in the fixing device 100 and thus the prior sheet is decelerated, with the result that the trailing end of the prior sheet and the leading end of the subsequent sheet fed at the speed Vw overlaps with each other (indicated by an arrow in the figure).

On the other hand, in the type of part (a) of FIG. 15, the gap time $\Delta T$ is sufficiently ensured before the feeding speed of the prior sheet lowers in the fixing device 100, so that even when the sheet feeding speed Vw similarly lowers in the fixing device 100, it becomes possible to prevent overlapping between the trailing end of the prior sheet and the leading end of the subsequent sheet. Further, according to part (b) of FIG. 15, by increasing the sheet feeding speed after the sheet passing through the fixing device 100, although the sheet feeding speed Vw in the fixing device 100 is decreased by increasing the sheet interval time $\Delta T$, it becomes possible to make arrival timing of the leading end of the prior sheet at the discharge position.

In this embodiment, in execution of the remedial action, the type in which only the sheet feeding speed (fixing rotational speed) of the fixing device 100 is decreased without decreasing the sheet feeding speed at portions other than the fixing device 100 was described. However, as a fourth method, also by employing a method in which the throughput is decreased by decreasing the sheet feeding speed in the entirety of the printer 1 (i.e., by decreasing also the fixing rotational speed), it is possible to achieve a similar effect. In this fourth method, control of the feeding speed can be further simplified.

7) The first rotational speed and the second rotational speed are the following speeds.

A distance from the first sheet detecting detect A1 of the entrance sensor S1 to the second sheet detecting position A2 of the exit sensor S2 is Ls.

In the case where a first sheet with a fixing direction length of L1 is fed through the nip N by the fixing roller 40 rotating at a first rotational speed, from predetermined timing when this sheet reaches the second sheet detecting position A2, the jam detecting portion stops rotation of the fixing roller 40 on the basis of an output of the exit sensor S2. At this time, a distance in which the sheet is fed by the fixing roller 40 in a period until the rotation of the fixing roller 40 is stopped in response to detection of the occurrence of the jam by the jam detecting portion is $\Delta L1$.

In the case where a second sheet with a fixing direction length of L1 is fed through the nip N by the fixing roller 40 rotating at a second rotational speed, from predetermined timing when this sheet reaches the second sheet detecting position A2, the jam detecting portion stops rotation of the fixing roller 40 on the basis of an output of the exit sensor S2. At this time, a distance in which the sheet is fed by the fixing roller 40 in a period until the rotation of the fixing roller 40 is stopped in response to detection of the occurrence of the jam by the jam detecting portion is $\Delta L2$.

The first rotational speed is a speed satisfying a relationship of $L2<Ls+\Delta L1 \leq L1$. The second rotational speed is a speed satisfying a relationship of $Ls+\Delta L2 \leq L2$.

Further, in the case where a third sheet for which the fixing device direction length is a third length L3 shorter than the feeding direction length L2 of the second sheet and the width and the basis weight are equal to those of the second sheet is fed through the nip N, the controller 24 may also cause the fixing roller 40 to rotate at a third speed slower than the second speed. That is, the controller 24 causes the fixing roller 40 to rotate at the third speed at which the presence of the third sheet is detectable by the entrance sensor S1 when the rotation of the fixing roller 40 is stopped in response to detection of the occurrence of the jam by the jam detecting portion during passing of the third sheet through the nip N.

8. In the constitution of this embodiment, the following case exists.

In the case where a predetermined sheet with a long-side length of L1 and a short-side length of L2 is fed through the nip N, when the predetermined sheet is fed through the nip N with a first orientation in which the feeding direction length thereof is the long side length thereof, an operation is as follows. The controller 24 causes the fixing roller 40 to rotate at a first speed at which the presence of the predetermined sheet is detectable by the entrance sensor S1 when the rotation of the fixing roller 40 is stopped in response to detection of the occurrence of the jam by the jam detecting portion during passing of the predetermined sheet through the nip N.

Further, when the predetermined sheet is fed through the nip N with a first orientation in which the feeding direction length thereof is the long side length thereof, an operation is as follows. The controller 24 causes the fixing roller 40 to rotate at a second speed slower than the first speed. That is, the controller 24 causes the fixing roller 40 to rotate at the second speed at which the presence of the predetermined sheet is detectable by the entrance sensor S1 when the rotation of the fixing roller 40 is stopped in response to detection of the occurrence of the jam by the jam detecting portion during passing of the predetermined sheet through the nip N.

Embodiment 2

FIG. 16 is a flowchart of heat setting and a printing operation in this embodiment (Embodiment 2). Basically, the flowchart is similar to the flowchart of FIG. 10 in Embodiment 1, but in this embodiment, sheet selection on the basis of the feeding direction length L of the sheet P detected at the sheet feeding portion of the printer 1 will be described. As regards the sheets set in the sheet feeding cassettes 9 and 10, or in the large-capacity sheet feeding device 11, as the sheet feeding portion described in Embodiment 1, as described above, the end detecting portion for detecting the length of the sheets measured in the feeding direction (i.e., the feeding direction length) by the end fences 52 (FIG. 2) slidable in the sheet feeding direction is provided.

In this embodiment, the sheet length L detected by the end detecting portion is notified to the controller 24 (S16-1, S16-2, S16-3). Then, an operation flow of S16-4 to S16-10 on the basis of discrimination of "YES" or "NO" in S16-3 is similar to the operation flow of S10-3 to S10-9 in the flowchart of FIG. 10, respectively.

FIG. 17 is another flowchart of heat setting and a printing operation in this embodiment (Embodiment 2). Basically, the flowchart is similar to the flowchart of FIG. 13 in Embodiment 1, but in this embodiment, sheet selection is on the basis of the feeding direction length L of the sheet P detected at the sheet feeding portion of the printer 1 similarly as in the case of FIG. 16. That is, the sheet length L detected by the end detecting portion is notified to the controller 24 (S17-1, S17-2, S17-3). Then, an operation flow of S17-4 to S17-11 on the basis of discrimination of "YES" or "NO" in S17-3 is similar to the operation flow of S13-3 to S13-10 in the flowchart of FIG. 13, respectively.

Embodiment 3

FIG. 18 is a flowchart of heat setting and a printing operation in this embodiment (Embodiment 3). In this embodiment, printing operation control on the basis of the feeding direction length L detected for the sheet during feeding in the printer 1 will be described. Other constitutions are similar to those of Embodiments 1 and 2, and therefore will be omitted from description.

In the printer 1 of this embodiment, a sheet length detecting portion for automatically detect the length of the sheet during feeding is provided at, as the sheet feeding portions, the feeding rollers of the sheet feeding cassettes 9 and 10, the feeding roller of the large-capacity sheet feeding device 11, the feeding roller of the manual feeding tray 12, or the registration roller pair 14. This detecting portion automatically detects the length of the sheet during feeding, for example, from a roller rotation time required for passing of a single sheet P and from an outer peripheral length of the roller. Sheet length information automatically detected by the sheet length detecting portion is transmitted to the controller 24.

In this embodiment, the printing operation control is carried out on the basis of the feeding direction length L, of the sheet during feeding, detected by the above-described sheet length detecting portion. That is, as shown in FIG. 18, the feeding direction length L, of the sheet during feeding, detected by the sheet length detecting portion is notified to the controller 24 (S18-1, S18-2, S18-3). Then, an operation flow of S18-4 to S18-8 on the basis of discrimination of "YES" or "NO" in S18-3 is similar to the operation flow of S10-3 to S10-7 in the flowchart of FIG. 10, respectively.

On the other hand, in S18-7, in the case where $L<Ls+\Delta L'$ is satisfied, in view of a state in which sheet stagnation cannot be detected in the fixing device, a warning message is displayed before the sheet P reaches the fixing device 100 (S18-9). Then, until before the sheet P reaches the fixing device 100, the controller 24 makes jam discrimination in order to intentionally cause the jam of the sheet P (S18-10) and stops feeding of the sheet (S18-11).

At this time, a type capable of suppressing a state in which the sheet P remains in the fixing device 100, such as a method of lowering the feeding speed Vw without displaying the warning message (S18-8) or the like may be used.

Embodiment 4

FIG. 19 is a flowchart of heat setting and a printing operation in this embodiment (Embodiment 4). In this embodiment, sheet setting and printing operation control on the basis of physical property information and the feeding direction length L of the sheet will be described. Incidentally, other constitutions are similar to those of Embodiment 1 to 3 and therefore will be omitted from description.

When the sheet size is inputted from the operating portion 23 or the sheet size is detected by the automatic detection at the sheet feeding cassettes 9 and 10 or the large-capacity sheet feeding device 11 (S19-1), discrimination of the feeding direction length L of the sheet is made (S19-2).

In S19-2, in the case of $L \geq Ls+\Delta L$, as described above, even when the jam generated in the fixing device 100, the trailing end of the sheet stopped due to the jam is detectable by the entrance sensor S1. In this case, similarly as in S10-3 of FIG. 10, the operation goes to the printing operation (S19-3). The printing operation in S19-3 is the normal printing operation under setting such that the sheet feeding speed in the entirety of the printer 1 is Vw.

Incidentally, as regards the jam generated in the fixing device 100, winding jam (FIG. 4) of the sheet P about the fixing roller 40 would be considered as a jam such that the leading end of the sheet does not reach the exit sensor S2. The winding jam generates in such a manner that the toner image t formed on the sheet P is melted in the nip N and increases in adhesiveness and thus adhesion of the sheet P exceeds rigidity based on stiffness of the sheet P.

Here, in the case of $Wp \geq W$ where the basis weight of the sheet selected during sheet setting is Wp and the basis weight of the sheet in which the stiffness causing no fixing winding jam can be ensured is W (YES of S19-4), the operation goes to the printing operation (S19-3). This printing operation is the normal printing operation under setting such that the sheet feeding speed in the entirety of the printer 1 is Vw. Incidentally, the basis weight W of the sheet in which the stiffness causing no fixing winding jam can be ensured falls within a basis weight range settable in the sheet setting. That is, when the basis weight range (in which the image is formable in the image forming apparatus 1) settable in the sheet size inclusive of the case of $L \geq Ls+\Delta L$ is not less than Wmin and not more than Wmax, the relationships of: $Wmin \leq W \leq Wmax$ and $Wmin \leq Wp \leq Wmax$ are satisfied.

On the other hand, in the case where $Wp \geq W$ is not satisfied, i.e., when the basis weight Wp of the sheet used is less than a predetermined amount (NO of S19-3), the flow goes to an operation flow of S19-5 and the later. The operation flow of S19-5 to S19-10 are similar to the operation flow of S10-4 to S10-9 in the flowchart of FIG. 10, respectively.

A type capable of suppressing a state in which the sheet P remains in the fixing device 100, such as a method of lowering the feeding speed Vw without displaying the warning message (S19-8) or the like may be used.

That is, in this embodiment, in the case where the sheet has the basis weight in which the winding jam does not generate (Wp≥W), even when the feeding direction length L satisfies L<Ls+ΔL, the printing operation is performed without lowering the sheet feeding speed from Vw.

In the case of the sheet satisfying L<Ls+&D % L, there is a liability that the sheet P stagnating in the fixing device 100 cannot be detected by the entrance sensor S1. However, the sheet satisfies the relationships of L>ΔL and L>Ls, $_{an}$d therefore, when the winding jam does not generate, the stagnation of the sheet can be detected by the exit sensor S2. As a result, as regards the sheet P satisfying the relationships of L<Ls+ΔL and Wp>W, the sheet stagnating in the fixing nip can be detected with reliability. Further, when this sheet P is applied to a device in which the throughput is lowered with a decreasing sheet feeding speed Vw, it is possible to suppress the lowering in throughput for the sheet P satisfying the relationships of L>Ls+ΔL and Wp>W.

Embodiment 5

In the above-described Embodiments 1 to 4, a constitution in which in the case where the inputted or detected feeding direction length L of the sheet in the sheet setting satisfies L<Ls+ΔL, the sheet feeding speed is lowered to Vw' so as to satisfy L≥Ls+ΔL' was employed. In this embodiment, in the case of L<Ls+ΔL (for example, in the case of "NO" of S10-2), the sheet feeding speed is not reduced. Other constitutions are similar to those in the above-described embodiments and therefore will be omitted from description.

In this embodiment, in the case where the inputted or detected feeding direction length L of the sheet in the sheet setting satisfies L<Ls+ΔL, the sheet feeding speed is not changed, and only the sheet causing no winding jam (Wp≥W) is permitted to use in the printing operation. That is, in the case where L<Ls+ΔL and Wp≥W are satisfied, the sheet is permitted to be used in the printing operation. Here, Wp is the basis weight of the sheet selected by the operator during sheet setting similarly as in Embodiment 4, and W is the basis weigh of the sheet in which stiffness causing no fixing winding jam can be ensured.

In the sheet setting, in the case where the inputted or detected feeding direction length L of the sheet satisfies L<Ls+ΔL, when the sheet having the basis weight in which the winding jam can generate (Wp<W), the use of the sheet in the printing operation is prohibited. Incidentally, use of the sheet satisfying L≥Ls+ΔL is permitted. That is, in the case of L≥Ls+ΔL, both of the sheet satisfying Wp<W and the sheet satisfying Wp>W are permitted to be used in the printing operation.

Also in the constitution of this embodiment, as regards the sheet P satisfying L<Ls+ΔL and Wp≥W, the sheet stagnating in the nip N can be detected with reliability.

As an example of specific control, the controller (registration controller) 24 controls the operating portion 23, so that an screens (FIG. 9A to FIG. 9C) of information input of the sheets P set in the sheet feeding portions 9 to 12, input of the sheet satisfying L<Ls+ΔL and Wp<W is prohibited. Incidentally, the basis weight W of the sheet in which the stiffness causing no fixing winding jam can be ensured falls within a basis weight range settable in the sheet setting. That is, when the basis weight range (in which the image is formable in the image forming apparatus 1) settable in the sheet size inclusive of the case of L≥Ls+ΔL is not less than Wmin and not more than Wmax, the relationships of: Wmin≤W≤Wmax and Wmin≤Wp≤Wmax are satisfied. In an example of the case of FIG. 9C, as an example, Wmin is 52 gsm, and Wmax is 300 gsm. Similarly, the length L inputted in the sheet signal falls within a range (Lmin or more and Lmax or less) settable in the sheet signal. Specifically, in the signal screen of the sheet size as shown in FIG. 9B, in the case where a sheet size satisfying L<Ls+ΔL is inputted, in the screen shown in FIG. 9C in which the basis weight of the sheet is selected, an option (choice) of Wp<W is in a gray-cut state. Incidentally, the option of Wp<W may also be not displayed on the screen.

For example, in the case of a constitution in which the operator is caused to select the basis weight in advance of the sheet size, when the basis weight of Wp<W is selected on the screen shown in FIG. 9C, on the input screen of the sheet size shown in FIG. 9B, input of the sheet size satisfying L<Ls+ΔL is prohibited, and input of the sheet size satisfying L≥Ls+ΔL is permitted. For example, in the case where Lmin≤182 mm≤Lmax and it is difficult to detect the sheet with L≤182 mm by the entrance sensor S1, input of the sheet size satisfying Lmin≤182 mm≤Lmax is prohibited, and input of the sheet size satisfying Lmin≤182 mm≤Lmax is permitted.

In this embodiment, the example in which the input is prohibited was employed, but a constitution in which an error screen is displayed in response to input of sheet information satisfying L<Ls+ΔL and Wp<W by the operator and in which registration of the sheet satisfying L<Ls+ΔL and Wp<W is prohibited may also be employed.

In FIGS. 9B and 9C, input of the irregular sheet size was described as an example, but the screens of these figures may also be applied to a constitution in which the regular sheet size is selected.

The sheet signal control described in this embodiment (Embodiment 5) is summarized and supplemented as follows.

1) The controller (registration controller) 24 permits registration of the first sheet of predetermined length in feeding direction length and the first basis weight in basis weight in association with the accommodating portion. The controller 24 prohibits registration of the second sheet of the predetermined length in feeding direction length and the second basis weight, in basis weight, smaller than the first basis weight in association with the accommodating portion.

2) A first receiving portion (window 329 of FIG. 9B) for receiving information corresponding to the feeding direction length of the sheet accommodated in the accommodating portion and a second receiving portion (FIG. 9C) for receiving information corresponding to the basis weight of the sheet accommodated in the accommodating portion are provided.

In the case where information indicating that the feeding direction length of the sheet accommodated in the accommodating portion is the above-described predetermined length is received by the first receiving portion, the controller (registration controller) 24 permits reception of information corresponding to the first basis weight by the second receiving portion, but prohibits reception of information corresponding to the second basis weight by the second receiving portion.

3) The controller (registration controller) 24 causes the display portion 32 to display a first screen (FIG. 9B) through which information corresponding to the feeding direction length of the sheet accommodated in the accommodating portion is inputted. In the case where information corresponding to a predetermined length is inputted toner the first screen, on a second screen (FIG. 9C) through which information corresponding to the basis weight of the sheet accommodated in the accommodating portion displayed at the display portion is inputted, the controller 24 permits input of information corresponding to the first basis weight, but prohibits input of information corresponding to the second basis weight.

4) The controller (registration controller) 24 causes the display portion 32 to display a first screen (FIG. 9B) through which information corresponding to the feeding direction length of the sheet accommodated in the accommodating portion is inputted. In the case where information corresponding to a predetermined length is inputted toner the first screen, on a second screen (FIG. 9C) through which the basis weight of the sheet accommodated in the accommodating portion displayed at the display portion is selected, an option corresponding to the first basis weight is displayed, but an option corresponding to the second basis weight is not displayed.

5) A first receiving portion (FIG. 9C) for receiving information corresponding to the basis weight of the sheet accommodated in the accommodating portion and a second receiving portion (FIG. 9B) for receiving information corresponding to the feeding direction length of the sheet accommodated in the accommodating portion are provided.

In the case where the first receiving portion receives information corresponding to the first basis weight, the controller (registration controller) 24 permits receipt of information corresponding to the predetermined length by the first receiving portion. In the case where the first receiving portion receives information corresponding to the second basis weight, the controller 24 prohibits receipt of information corresponding to the predetermined length by the second receiving portion.

6) The controller (registration controller) 24 causes the display portion 32 to display the first screen (FIG. 9C) through which the information corresponding to the basis weight accommodated in the ccommodating portion. In the case where information corresponding to the first basis weight is inputted through the first screen, the controller 24 permits input of a predetermined length through the second screen through which information corresponding to the feeding direction length of the sheet accommodated in the accommodating portion displayed at the display portion is inputted. In the case where information corresponding to the second basis weight is inputted through the first screen, the controller 24 prohibits input of the predetermined length through the second screen.

7) The controller (registration controller) 24 causes the display portion 32 to display the first screen (FIG. 9C) through which the information corresponding to the basis weight accommodated in the accommodating portion. In the case where information corresponding to the first basis weight is inputted through the first screen, the controller 24 causes the display portion 32 to display an option of a predetermined length on the second screen (FIG. 9B) through which information corresponding to the feeding direction length of the sheet accommodated in the accommodating portion displayed at the display portion is selected. In the case where information corresponding to the second basis weight is inputted through the first screen, the controller 24 does not cause the display portion 32 to display the option of the predetermined length on the second screen.

Other Embodiments (1) As the fixing device 100, a fixing device for heat-fixing the toner image t on the sheet was described as an example, but the fixing device 100 is not limited thereto. For example, a device for increasing a gloss (glossiness) of an image by re-fixing the toner image, under heating, which has been temporarily been fixed on the sheet (also in this case, the device is referred to as the fixing device) may also be used.

(2) The image forming apparatus is not limited to the full-color image forming apparatus of the electrophotographic type, but may also be an image forming apparatus for forming a monochromatic image. Further, the image forming type is not limited to the electrophotographic type. The image forming apparatus may also be an image forming apparatus for forming the toner image in a direct type or a transfer type by using another type such as an electrostatic recording type or a magnetic recording type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications

Nos. 2017-100637 filed on May 22, 2017 and 2018-077409 filed on Apr. 13, 2018, which are hereby incorporated by reference herein in their entirety.

What is claimed is:

1. An image forming apparatus comprising:

an image forming portion configured to form a toner image on a fed sheet;

first and second rotatable members configured to form a nip for fixing the toner image on the sheet while feeding the sheet fed from said image forming portion;

a jam detecting portion configured to detect occurrence of a jam;

a detector configured to detect the sheet remaining in the nip, at a detecting position on a side upstream of the nip with respect to a sheet feeding direction; and a controller configured to control a rotational speed of said first rotatable member depending on a length, measured in the feeding direction, of the sheet to be fed to the nip, wherein when the sheet to be fed to the nip is a first sheet having a first length measured in the feeding direction and having a first width measured in a widthwise direction perpendicular to the feeding direction, said controller causes said first rotatable member rotating at a first speed to feed the first sheet, and when the sheet to be fed to the nip is a second sheet having a second length measured in the feeding direction shorter than the first length and having the first width measured in the widthwise direction, said controller causes said first rotatable member rotating at a second speed slower than the first speed to feed the second sheet, and wherein said controller stops rotation of said first rotatable member in response to detection of the occurrence of the jam by said jam detecting portion.

2. An image forming apparatus according to claim 1, wherein said detector includes a lever, an urging portion configured to urge said lever toward the detecting position, and a sensor configured to detect a position of said lever.

3. An image forming apparatus according to claim 1, further comprising:

an accommodating portion configured to accommodate the sheet to be fed to said image forming portion, and an acquiring portion configured to acquire information on the length, measured in the feeding direction, of the sheet accommodated in said accommodating portion, wherein said controller controls a rotational speed of said first rotatable member on the basis of the information acquired by said acquiring portion.

4. An image forming apparatus according to claim 3, further comprising an operating portion through which the information on the length, measured in the feeding direction, of the sheet accommodated in said accommodating portion is inputtable by an operation of an operator, wherein said acquiring portion acquires the information on the length, measured in the feeding direction, of the sheet inputted through said operating portion.

5. An image forming apparatus according to claim 1, wherein the first speed is a speed at which the first sheet remaining in the nip is detectable by said detector when the rotation of said first rotatable member is stopped in response to the detection of the jam by said jam detecting portion during passing of the first sheet through the nip, and the second speed is a speed at which the second sheet remaining in the nip is detectable by said detector when the rotation of said first rotatable member is stopped in response to the detection of the jam by said jam detecting portion during passing of the second sheet through the nip.

6. An image forming apparatus according to claim 5, further comprising a second detector configured to detect the sheet at a second detecting position subsequent to the first detecting position by said detector with respect to the feeding direction, wherein the first speed satisfies a relationship of $L2<Ls+\Delta L1\leq L1$, and the second speed satisfies a relationship of $Ls+\Delta L2\leq L2$ when L1 is the first speed, L2 is the second speed, Ls is a distance from the first detecting position to the second detecting position, ΔL1 is a distance in which the first sheet is fed by said first rotatable member in a period from predetermined timing of arrival of the first sheet at the second detecting position to an end of a stop of the rotation of said first rotatable member in response to the detection of occurrence of the jam by said jam detecting portion on the basis of the output of said second detector when said first rotatable member rotating at the first speed feeds the first sheet, and ΔL2 is a distance in which the second sheet is fed by said first rotatable member in a period from predetermined timing of arrival of the second sheet at the second detecting position to an end of a stop of the rotation of said first rotatable member in response to the detection of occurrence of the jam by said jam detecting portion on the basis of the output of said second detector when said first rotatable member rotating at the second speed feeds the second sheet through the nip.

7. A image forming apparatus according to claim 1, wherein the first sheet and the second sheet have the same basis weight.

8. An image forming apparatus according to claim 1, wherein when the sheet to be fed to the nip is a third sheet which has the same size as that of the second sheet and which has a basis weight larger than that of the second sheet, said controller causes said first rotatable member rotating at the first speed to feed the third sheet.

9. An image forming apparatus according to claim 1, wherein when the sheet to be fed to the nip is a third sheet having a third length shorter than the second length measured in the feeding direction, said controller causes said first rotatable member rotating at a third speed slower than the second speed to feed the third sheet.

10. An image forming apparatus comprising:

an image forming portion configured to form a toner image on a fed sheet;

first and second rotatable members configured to form a nip for fixing the toner image on the sheet while feeding the sheet fed from said image forming portion;

a jam detecting portion configured to detect occurrence of a jam;

a detector configured to detect the sheet remaining in the nip, at a detecting position on a side upstream of the nip with respect to a sheet feeding direction; and a controller configured to stop rotation of said first rotatable member in response to detection of the occurrence of the jam by said jam detecting portion, wherein when a first sheet having a first length measured in the feeding direction, having a first width measured in a widthwise direction perpendicular to the feeding direction, and having a first basis weight, said first rotatable member feeds the first sheet while rotating at a first speed, and when a second sheet having a second length measured in the feeding direction shorter than the first length, having the first width measured in the widthwise direction, and having the first basis weight, said first rotatable member feeds the second sheet while rotating at a second speed slower than the first speed.

11. An image forming apparatus according to claim 10, wherein said detector includes a lever, an urging portion configured to urge said lever toward the detecting position, and a sensor configured to detect a position of said lever.

12. An image forming apparatus according to claim 10, wherein the first speed is a speed at which the first sheet remaining in the nip is detectable by said detector when the rotation of said first rotatable member is stopped in response to the detection of the jam by said jam detecting portion during passing of the first sheet through the nip, and the second speed is a speed at which the second sheet remaining in the nip is detectable by said detector when the rotation of said first rotatable member is stopped in response to the detection of the jam by said jam detecting portion during passing of the second sheet through the nip.

13. An image forming apparatus according to claim 12, further comprising a second detector configured to detect the sheet at a second detecting position subsequent to the first detecting position by said detector with respect to the feeding direction, wherein the first speed satisfies a relationship of $L2<Ls+\Delta L1\leq L1$, and the second speed satisfies a relationship of $Ls+\Delta L2\leq L2$ when L1 is the first speed, L2 is the second speed, Ls is a distance from the first detecting position to the second detecting position, ΔL1 is a distance in which the first sheet is fed by said first rotatable member in a period from predetermined timing of arrival of the first sheet at the second detecting position to an end of a stop of the rotation of said first rotatable member in response to the detection of occurrence of the jam by said jam detecting portion on the basis of the output of said second detector when said first rotatable member rotating at the first speed feeds the first sheet, and $\Delta L2$ is a distance in which the second sheet is fed by said first rotatable member in a period from predetermined timing of arrival of the second sheet at the second detecting position to an end of a stop of the rotation of said first rotatable member in response to the detection of occurrence of the jam by said jam detecting portion on the basis of the output of said second detector when said first rotatable member rotating at the second speed feeds the second sheet through the nip.

14. An image forming apparatus according to claim 10, further comprising, a notifying portion configured to notify an operator of information, and an acquiring portion configured to acquire information on the length, measured in the feeding direction, of the sheet accommodated in an accommodating portion and information on the width of the sheet measured in a widthwise direction perpendicular to the feeding direction, wherein when the information acquired by said acquiring portion indicates that the length measured in the feeding direction is the second length and that the width measured in the widthwise direction is a second width which is not less than the first length, said notifying portion prompts the operator to change an orientation of the sheet accommodated in said accommodating portion.

15. An image forming apparatus comprising:

an accommodating portion configured to accommodate a sheet on which a toner image is to be formed;

an image forming portion configured to form a toner image on a sheet fed from said accommodating portion;

first and second rotatable members configured to form a nip for fixing the toner image on the sheet while feeding the sheet fed from said image forming portion;

a jam detecting portion configured to detect occurrence of a jam;

a detector configured to detect the sheet remaining in the nip, at a detecting position on a side upstream of the nip with respect to a sheet feeding direction; and a rotation controller configured to control a rotational speed of said first rotatable member depending on a length, measured in the feeding direction, of the sheet to be fed to the nip, wherein said rotation controller stops the rotation of said first rotatable member in response to detection of the occurrence of the jam by said jam detecting portion; and a registration controller configured to register information of the sheet accommodated in said accommodating portion in association with said accommodating portion;

wherein said registration controller permits registration of a first sheet having a first length measured in the feeding direction and having a first basis weight, in association with said accommodating portion, permits registration of a second sheet having the first length and having a second basis weight smaller than the first basis weight, in association with said accommodating portion, permits registration of a third sheet having a second length measured in the feeding direction shorter than the first length and having the first basis weight in association with the accommodating portion, and prohibits registration of a fourth sheet having the second length and having the second basis weight, in association with said accommodating portion.

16. An image forming apparatus according to claim 15, wherein said detector includes a lever, an urging portion configured to urge said lever toward the detecting position, and a sensor configured to detect a position of said lever.

17. An image forming apparatus according to claim 15, wherein said registration controller is capable of displaying, at a display portion, a first screen through which the length, measured in the feeding direction, of the sheet accommodated in said accommodating portion is inputted and a second screen through which the basis weight of the sheet accommodated in said accommodating portion is inputted, and wherein when the second length is inputted through the first screen, said registration controller permits input of the first basis weight on the second screen displayed at said display portion and prohibits input of the second basis weight on the second screen displayed at said display portion.

18. An image forming apparatus according to claim 17, further comprising said display portion.

19. An image forming apparatus according to claim 15, wherein said registration controller is capable of displaying, at a display portion, a first screen through which the basis weight of the sheet accommodated in said accommodating portion is inputted and a second screen through which the length, measured in the feeding direction, of the sheet accommodated in said accommodating portion is inputted.

wherein when information associated with the first basis weight is inputted through the first screen, said registration controller permits input of the first basis weight on the second screen displayed at said display portion, and when information associated with the second basis weight is inputted on the first screen, said registration controller prohibits input of the information associated with the second length on the second screen displayed at said display portion, said registration controller prohibits input of the information associated with the second length on the second displayed at said display portion.

20. An image forming apparatus according to claim 19, further comprising said display portion.

21. An image forming apparatus according to claim 15, further comprising a second detector configured to detect the sheet at a second detecting position subsequent to the first detecting position by said detector with respect to the feeding direction, wherein the second length satisfies a relationship of $L<Ls+\Delta L$, when L is the second length, Ls is a distance from the first detecting position to the second detecting position, and $\Delta L$ is a distance in which the second sheet is fed by said first rotatable member in a period from predetermined timing of arrival of the second sheet at the second detecting position to a stop of the rotation of said first rotatable member in response to the detection of occurrence of the jam by said jam detecting portion on the basis of the output of said second detector when the second sheet is fed through the nip.

* * * * *